US006087056A

United States Patent [19]

Toyoshima et al.

[11] Patent Number: 6,087,056

[45] Date of Patent: Jul. 11, 2000

[54] DEVELOPING METHOD BY FLYING TONER

[75] Inventors: Tetsuro Toyoshima, Soraku-gun; Tadashi Iwamatsu, Nara; Nobuyuki Azuma, Ibaraki; Hideaki Fujita; Takayuki Yamanaka, both of Tenri, all of Japan

[73] Assignee: Sharp Kabushiki Kaisha, Tokyo, Japan

[21] Appl. No.: 09/307,180

[22] Filed: May 7, 1999

Related U.S. Application Data

[63] Continuation-in-part of application No. 08/612,583, Mar. 8, 1996, abandoned.

[30] Foreign Application Priority Data

Mar. 8, 1995 [JP] Japan ..... 7-048536

[51] Int. Cl.[7] ..... G03G 15/08; G03G 15/14

[52] U.S. Cl. ..... 430/102; 430/126

[58] Field of Search ..... 430/110, 102, 430/126; 399/265

[56] References Cited

U.S. PATENT DOCUMENTS

| | | | |
|---|---|---|---|
| 4,666,814 | 5/1987 | Seumatsu et al. | 430/126 |
| 4,666,815 | 5/1987 | Imai et al. | 430/126 |
| 5,215,849 | 6/1993 | Makuta et al. | 430/110 |
| 5,239,342 | 8/1993 | Kubo et al. | 355/245 |
| 5,296,324 | 3/1994 | Akagi et al. | 430/110 |
| 5,387,963 | 2/1995 | Kajimoto et al. | 355/215 |
| 5,474,869 | 12/1995 | Tomita et al. | 430/111 |
| 5,503,954 | 4/1996 | Maruta et al. | 430/110 |

FOREIGN PATENT DOCUMENTS

| | | |
|---|---|---|
| 41-9475 | 5/1965 | Japan . |
| 53-003237 | 1/1978 | Japan . |
| 58-079260 | 5/1983 | Japan . |
| 59-7098 | 2/1984 | Japan . |
| 60-87343 | 5/1985 | Japan . |
| 60-87347 | 5/1985 | Japan . |
| 2-45191 | 10/1990 | Japan . |
| 5-232802 | 10/1993 | Japan . |
| 5-297711 | 11/1993 | Japan . |

OTHER PUBLICATIONS

"One Drum Color Superimposing Process–DC Electric Field Flying–Development" by Hajime Yamamoto et al, in "Journal of Society of Electro–photograph of Japan" vol. 29, No. 1, 1990, pp. 9–13.

"Electrostatic Influence of the Toner Layer on the Photoconductor" by Hajime Yamamoto et al., in "Sixth International Congress on Advances in Non–Impact Printing Technologies" pp 34–43, 1990.

J.C. Agui, et al., "Mechanism of Monocomponent Noncontact Development" p. 129, paragraph 1—p. 132, paragraph 1, Proceedings: The Fifth International Congress on Advances in Non–Impact Printing Technologies, Nov. 17, 1989, SPSE–The Society for Imaging Science and Technology, San Diego, USA.

M.H. Lee, "Charge Distribution of Toner in Jump Development", p. 126, paragraph 1—p. 206 paragraph 2, Proceedings: The Sixth Interantional Congress on Advances in Non–Impact Printing Technologies, Oct. 21, 1990 The Society for Imaging Science and Technology, Orlando, USA.

Abstract for Japanese Publication Laid–open No. 60–87347, May 1985.

Abstract for Japanese Publication Laid–open No. 60–87343, May 1985..

*Primary Examiner*—John Y. Goodrow

[57] ABSTRACT

A toner which can exhibit 5 nN or less of inter-particle force calculated by the following equation (1) when the toner is laminated and carried on a toner carrier:

$$Fv=q\cdot E-Fi \quad (1)$$

where Fv is an inter-particle force, q·E is a Coulomb force calculated by the following equation:

$$q\cdot E=q\cdot\{Vb+(Q/M)\cdot\delta\cdot P\cdot dt_1^2/(2\epsilon o\epsilon_T)\}/(\epsilon_T\cdot g+dt_1) \quad (2)$$

where Fi is an image-force calculated by the following equation (3):

$$Fi=\{(W_1\cdot\pi d^3\cdot\delta)/(6\ \epsilon o\ \epsilon_T)\}\cdot(Q/M)^2 \quad (3)$$

where q is a quantity of charge [C] of the toner particle to be developed, E is an electric field strength [V/m] acting on the toner layer, Q/M is a toner charge-to-mass ratio [mC/g], $W_1$ is an amount of toner separated by development among the toner laminated and carried on the toner carrier, $\epsilon o$ is a vacuum dielectric constant [C/(V·m)], $\epsilon_T$ is an apparent specific dielectric constant [C/(V·m)] of the toner layer, d is an average particle size [$\mu$m] of the toner, $\delta$ is a true density [g/cm$^3$] of the toner, g is a gap [mm] between the outermost surface of the toner on the toner carrier and the electrostatic latent image holder, $dt_1$ is a thickness [$\mu$m] of the toner layer on the toner carrier, Vb is a development bias voltage [V] and P is a toner packing rate.

The present invention provides a toner and a non-contact developing method using the same which realize stable flying-development by suppressing to 5 nN or less the inter-particle force of the toner other than the image-force acting on the toner laminated and carried on the toner carrier.

16 Claims, 12 Drawing Sheets

FIG.12

| | | Item | | Symbol | Unit | Toner A | Toner B | Toner C | Toner D | Toner E | Toner F |
|---|---|---|---|---|---|---|---|---|---|---|---|
| Properties of Toner | [1] | toner particle size | | d | μm | 12.3 | 7.3 | 7.3 | 7.3 | 8.1 | 9.1 |
| | [2] | specific dielectric constant | | εt | | 1.9 | 4.3 | 3.3 | 3.9 | 3.3 | 3.1 |
| | [3] | true density | | δ | g/cm$^3$ | 1.1 | 1.1 | 1.1 | 1.1 | 1.1 | 1.1 |
| | [4] | external additive | | | | nil | nil | 0.02 μm silica | 0.5 μm conductive particle | 0.02 μm silica | 0.02 μm silica |
| Developing Conditions | [5] | gap | | g | mm | 0.15 | 0.2 | 0.13 | 0.13 | 0.13 | 0.13 |
| | [6] | bias voltage | | Vb | V | 800 | 700 | 700 | 700 | 700 | 700 |
| Measured values | [7] | average charge-to-mass ratio | | Q/M | μC/g | 2.1 | 31.9 | 14.0 | 5.1 | 7.3 | 8.2 |
| | [8] | toner mass per unit area on developing roller | | M/A | mg/cm$^2$ | 0.80 | 0.50 | 0.60 | 0.80 | 0.80 | 0.95 |
| | [9] | average surface potential of toner layer | | Vt | V | 12.0 | 22.8 | 16.3 | 15.2 | 19.3 | 20.0 |
| | [10] | flying amount (developed amount per one turn of developing roller) | | W1 | mg/cm$^2$ | 0.36 | 0.003 | 0.30 | 0.28 | 0.30 | 0.50 |
| | [11] | half-value width of distribvtion of charge-to-mass ratio | | b | μC/g | 15.8 | not measured | 11.8 | 12.0 | 12.2 | 13.5 |
| | [12] | rate of number of wrong sign toners | | Rn | | 35.0% | not measured | 1.5% | 9.9% | 5.1% | 3.3% |
| | [13] | voluminal rate of wrong sign toners | | Rv | | 28.5% | not measured | 1.4% | 9.8% | 5.2% | 3.0% |
| | [14] | target value of developed amount | | | mg/cm$^2$ | 0.30 | 0.30 | 0.30 | 0.30 | 0.30 | 0.50 |
| Calculated Values | | | equation | | | | | | | | |
| | [15] | apparent specific dielectric constant | (9) | $\varepsilon_1$ | | 1.38 | 2.99 | 2.48 | 2.36 | 2.26 | 2.66 |
| | [16] | electric field strength | (11) | E | MV/m | 3.63 | 1.19 | 2.17 | 2.22 | 2.34 | 2.09 |
| | [17] | inter-particle force | (1) | Fv | nN | 6.77 | 8.28 | 0.79 | 1.76 | 2.79 | 1.00 |
| | [18] | upper limit of charge-to-mass ratio | (14) | (q/m)max | μC/g | 14.7 | 10.53 | 15.84 | 15.45 | 15.63 | 9.48 |
| | [19] | packing rate | (8) | P | | 0.42 | 0.60 | 0.64 | 0.47 | 0.55 | 0.74 |
| | [20] | packing density | [3] • [19] | δP | g/cm$^3$ | 0.46 | 0.66 | 0.71 | 0.51 | 0.60 | 0.82 |
| | [21] | thickness of toner layer | [8]/[20] | dt1 | μm | 17.4 | 7.6 | 8.5 | 15.5 | 13.2 | 11.6 |

DEVELOPING METHOD BY FLYING TONER

This application is a continuation-in-part of the now abandoned application Ser. No. 08/612,583 filed on Mar. 8, 1996, the entire contents of which are hereby incorporated by reference.

BACKGROUND OF THE INVENTION

1. Field of the Invention

The present invention relates to a toner to be used in image forming equipment such as a copier, a laser printer and a facsimile, and to a non-contact developing method using the same. More particularly, it relates to a toner applied to a non-contact developing unit for visualizing an electrostatic latent image by flying the toner to an electrostatic latent image holder facing to the toner on a toner carrier with a gap by electrostatic force, and to a non-contact developing method using the same.

2. Description of Related Art

Hitherto, there has been known an electrostatic copier in which charged toner is carried on a toner carrier and the toner and an electrostatic latent image holder are disposed in non-contact from each other to develop an electrostatic latent image by electrostatic force acting between the toner and the electrostatic latent image holder (see Japanese Patent Publication No. 41(1966)-9475). The publication No. 41-9475 teaches that the non-contact developing method allows a copied image having no background fog to be obtained because the toner deposits only on the location which corresponds to an image portion of the electrostatic latent image.

However, when the non-contact developing method is compared with a contact developing method, the latter method can carry the toner to an electrostatic latent image portion mechanically, while the non-contact developing method is required to fly the toner by electrostatic force and is unable to assure sufficient development unless the electrical property of the toner and the developing conditions of the developing unit are fully optimized.

Accordingly, the above-mentioned publication No. 41(1966)-9475 teaches merely the basic idea of the non-contact developing method and discloses nothing about the property of the toner and the developing conditions, so that it is difficult to implement it.

As a case of color development in which a non-magnetic monocomponent toner is flied in a DC electric field, an article (1) entitled "One Drum Color Superimposing Process -DC Electric Field Flying-Development" has been published in the Journal of Society of Electro-photograph of Japan, Vol. 29, No. 1, 1990.

According to the article (1), the color development in which the non-magnetic monocomponent toner is flying-developed in the DC electric field has been put into practical use by reducing image-force, which is an adhesive force, acting on the toner laminated on a toner carrier to increase the property of the toner for flying from the toner carrier to an electrostatic latent image holder.

Further, in order to give a sufficient flying property, a non-magnetic monocomponent toner having a relatively large particle size of 12 $\mu$m was used and a charge-to-mass ratio which is a quantity of charge per unit mass thereof was set at a low value of 1 to 5 $\mu$C/g.

This is because a large toner charge-to-mass ratio was believed to increase image-force Fi and to decrease the flying property of the toner, thus considerably decreasing the developability, because the image-force Fi, which is an electrostatic adhesive force of the toner, increases in proportion to the square of the charge-to-mass ratio. Accordingly, it was necessary to increase the particle size of the toner because the small toner particle size would increase the specific area of the toner, thereby increasing the toner charge-to-mass ratio as well.

Further, because the non-contact development requires larger Coulomb force than the contact development, the flying property of the toner having a small particle size would be considerably decreased when it is applied to the non-contact development. Due to that, there has been a problem that the toner having a small particle size which should otherwise be very effective in improving an image quality cannot be used in the non-contact developing method. The toner in the non-contact developing method has been limited to those having a large particle size and having a small charge-to-mass ratio.

The non-magnetic monocomponent toner is used in the DC electric field flying-development because it allows toner images of a plurality of colors to be superimposed without color mixture and is suited for color development.

Further, a method for increasing the flying property of the toner by giving mechanical vibration other than the electrostatic force in a developing section has been proposed as a method for reducing adhesive force of toner on a toner carrier.

In a developing unit described in Japanese Patent Laid-open No. Hei. 5(1993)-232802, a method for increasing the flying property by providing a vibrating member in contact with a belt-like toner carrier to reduce the adhesive force of the toner on the toner carrier has been disclosed.

In a color image forming equipment described in Japanese Patent Laid-open No. Hei. 5(1993)-297711, a mechanical impact is applied to the developing unit when it begins to fly the toner so that the toner having a small particle size can easily fly.

Further, when the non-magnetic monocomponent toner is used, the toner cannot be fully conveyed unless the fluidity of the toner is good, because the toner cannot be conveyed by magnetic force.

Then, there has been known a method of adding another kind of particles to the toner for the purpose of improving the chargeability and fluidity of the non-magnetic monocomponent toner as disclosed in, for example, Japanese Examined Patent Publication No. Sho. 59(1984)-7098 entitled "Electrostatic Latent Image Developing Method" and No. Hei. 2(1990)-45191 entitled "Developing Method".

In the above-mentioned publication No. 59(1984)-7098, a monocomponent developer containing hydrophobic silica in toner is charged by triboelectric charging and is then supplied to a developing section. Thereby the fluidity of the toner is enhanced to prevent coagulation.

In the publication No. Hei. 2(1990)-45191, 1 to 50 parts by weight of granulating silica powder having 1 to 100 $\mu$m of particle size is added into 100 parts by weight of insulating toner particle to improve a triboelectric charging performance of the toner.

Further, there has been known a method for carrying a toner having about 15 to 100 $\mu$m of thickness and 0.1 to 0.6 g/cm$^3$ of packing density on a toner carrier and flying-developing the toner through 100 to 500 $\mu$m of development gap as disclosed in, for example, U.S. Pat. No. 4,666,814 and Japanese Patent Laid-open No. Sho. 60(1985)-87347. Still more, there has been known a method for carrying a toner having about 15 to 80 $\mu$m of thickness, 0.1 to 0.6 g/cm$^3$ of packing density and $3\times10^{-10} \leqq |Q| \leqq 10^{-7}$ of charge density Q(C/m$^2$) on a toner carrier and flying-developing it through 100 to 500 $\mu$m of development gap as disclosed in U.S. Pat. No. 4,666,815 and Japanese Patent Laid-open No. Sho. 60(1985)-87343 for example.

Further, there has been known a method for carrying a toner having about 30 $\mu$m of thickness and 3 $\mu$C/g of charge-to-mass ratio on a toner carrier and flying-developing it through 100 to 500 $\mu$m of development gap as published in an article (2) entitled "Electrostatic Influence of the Toner Layer on the Photoconductor" in the Sixth International Congress on Advances in Non-Impact Printing Technologies, 1990, p. 34.

However, the flying-development using the toner having the large particle size and the low charge-to-mass ratio to improve the flying property thereof as described above has had a problem that it is apt to produce wrong sign toners (reverse polarity toners) and to cause background fog and a reduction of sharpness of edge, thus deteriorating the image quality.

This problem is outstanding especially when monocomponent toner is used. It is because the monocomponent toner is apt to produce a toner with the reverse polarity because it uses no carrier, whereas two-component toner is charged by friction between the carrier, having a charge polarity opposite to that of the toner, and the toner itself can be charged with a normal polarity. In particular, when monocomponent toner having a low charge-to-mass ratio is used the rate of the reverse polarity toner may reach to 30% in the toner to be developed.

Further, the method of developing the non-magnetic monocomponent toner in a DC electric field has had a problem that the toner layer is apt to be flown apart, as common to the non-magnetic toner. That is, while the non-magnetic toner is carried on the toner carrier mainly by image-force (electrostatic adhesive force) because it cannot be laminated and carried on the toner carrier by magnetic force like magnetic toner, the toner is apt to be flown apart because the toner having a small charge-to-mass ratio decreases the image-force, thus deteriorating the developability.

Although the method of developing the non-magnetic monocomponent toner in the DC electric field is suitable for color development, it has a number of disadvantages in terms of image quality as described above as compared to the conventional methods such as a two-component magnetic brush development. While a method of developing a black toner by the two-component magnetic brush development by using a toner having a small particle size and of developing only color toners by the non-contact developing method by using non-magnetic monocomponent toners having a relatively large particle size has been adopted sometimes as practical means for putting into use, it has had a problem that it complicates the equipment.

The toner having a large particle size has had a problem that a distance between a position of the center of gravity of the toner at the outermost surface of the toner carrier and an electrostatic latent image is separated, even though the development gap is constant, so that an electric field pattern of the latent image acting on the toner attenuates, thus decreasing a resolution of the image after the development.

Beside them, the non-contact development has had a problem of a phenomenon that a density at edge is emphasized depending on a development pattern due to the relation of the peripheral speed of the toner carrier with that of the electrostatic latent image holder.

Although the method disclosed in Japanese Patent Laid-open Publications No. Hei. 5(1993)-232802 and No. Hei. 5(1993)-297711 allow the toner having a small particle size to be used, they have problems such that the toner carrier is confined on a belt, separate means for applying mechanical vibration or impact is necessary and the equipment is complicated, thus increasing the cost.

Although the method disclosed in Japanese Examined Patent Publications No. Sho. 59(1984)-7098 and No. Hei. 2(1990)-45191 is effective in improving the chargeability and fluidity of the non-magnetic monocomponent toner by externally adding silica to the toner, it describes nothing about a correlation to the adhesive force acting on the toner, which is an important factor in the non-contact development.

Although the developing methods disclosed in U.S. Pat. No. 4,666,814 (Japanese Patent Laid-open No. Sho. 60(1985)-87347), U.S. Pat. No. 4,666,815 (Japanese Patent Laid-open No. Sho. 60(1985)-87343) and in the article (2) in the Sixth International Congress on Advances in Non-Impact Printing Technologies have a feature that the toner having less charge-to-mass ratio or charge density is carried on the toner carrier with a lower packing density and a thicker layer thickness, an experiment showed that the prior art developing method without considering the inter-particle force of the toner into account is not practical because its developability is remarkably inferior.

Actually, it has been found from the property of the toner, equations of the adhesive force and flying experiments that the adhesive force which acts on the toner laminated and carried on the toner carrier includes an adhesive force called the inter-particle force Fv other than the electrostatic adhesive force called the image-force Fi and that it is important to suppress the inter-particle force Fv, other than the image-force Fi, which act on the toner in non-contact developing. It has been also found from the experiment that the flying-development can be implemented fully with toner having a large charge-to-mass ratio regardless of the particle size thereof by reducing the inter-particle force Fv other than the electrostatic force.

Therefore, the toner having a small particle size which is very effective in improving the image quality may be adopted in the non-contact developing method by suppressing the inter-particle force and defining the size thereof, and thus the above-mentioned problems of the prior art can be solved.

SUMMARY OF THE INVENTION

Accordingly, it is an object of the present invention to solve the aforementioned problems by providing a toner and a non-contact developing method using the same which allows an excellent image quality to be obtained by suppressing inter-particle force Fv which is an adhesive force other than electrostatic force Fi acting on the toner.

The toner of the present invention can exhibit 5 nN or less of inter-particle force which is calculated by the following equation (1) when it is laminated and carried on a toner carrier:

$$Fv = q \cdot E - Fi \tag{1}$$

where Fv is an inter-particle force, q·E is a Coulomb force calculated by the following equation:

$$q \cdot E = q \cdot \{Vb + (Q/M) \cdot \delta \cdot P \cdot dt_1^2 / (2\epsilon o\ \epsilon_r)\} / (\epsilon_r \cdot g + dt_1) \tag{2}$$

where Fi is an image-force calculated by the following equation (3):

$$Fi=\{(W_1\cdot\pi d^3\cdot\delta)/(6\ \epsilon o\ \epsilon_T)\}\cdot(Q/M)^2 \quad (3)$$

where q is a quantity of charge [C] of the toner particle to be developed, E is an electric field strength [V/m] acting on the toner layer, Q/M is a charge-to-mass ratio [$\mu$C/g] of the toner, $W_1$ is an amount of the toner [mg/cm$^2$] separated by development among the toner which is laminated and carried on the toner carrier, co is a vacuum dielectric constant [C/(V·m)], ET is an apparent specific dielectric constant [C/(V·m)] of the toner layer, d is an average particle size [$\mu$m] of the toner, δ is a true density [g/cm$^3$] of the toner, g is a gap [mm] between the outermost surface of the toner on the toner carrier and the electrostatic latent image holder, $dt_1$ is a thickness [$\mu$m] of the toner layer on the toner carrier, Vb is a development bias voltage [V] and P is a toner packing rate.

It is another object of the present invention to provide a toner which allows the non-contact development even with the toner having a small particle size of 11 $\mu$m or less by reducing the inter-particle force of the toner from 0.01 nN to 5 nN.

It is still another object of the present invention to provide a toner which allows the non-contact development within a range in which the average particle size of the toner is 5 $\mu$m to 11 $\mu$m and the charge-to-mass ratio thereof is 5 $\mu$C/g to 15 $\mu$C/g.

It is a further object of the present invention to provide a toner which allows the non-contact development within the range in which a toner charge-to-mass ratio is 5 $\mu$C/g to 15 $\mu$C/g, the thickness of the toner laminated and carried on the toner carrier is about 5 $\mu$m to 20 $\mu$m and the packing density thereof is about 0.4 g/cm$^3$ to 0.85 g/cm$^3$.

It is a further object of the present invention to provide a non-contact developing method which can realize stable flying-development only by the means for controlling electrostatic force and field strength acting on the toner by suppressing the inter-particle force Fv which is an adhesive force other than the electrostatic force Fi acting on the toner to 5 nN or less.

It is another object of the present invention to provide a non-contact developing method in which the inter-particle force of the toner other than the electrostatic force acting on the toner which is laminated on the toner carrier is 5 nN or less and a charge-to-mass ratio thereof is controlled within a predetermined range.

It is still another object of the present invention to provide a non-contact developing method which can avoid an edge enhancement which is a problem intrinsic to the non-contact development.

It is a further object of the present invention to provide a non-contact developing method which can avoid the edge enhancement and can assure a required amount to be developed even if the toner charge-to-mass ratio is large and under a condition in which an amount of toner separated by the development among the toner laminated and carried on the toner carrier is small.

The above and other related objects and features of the present invention will be apparent from a reading of the following description of the disclosure found in the accompanying drawings and the novelty thereof pointed out in the appended claims.

BRIEF DESCRIPTION OF THE DRAWINGS

FIG. 12 is a table showing a result of a flying experiment of the toners of the present invention;

DESCRIPTION OF PREFERRED EMBODIMENTS

Figure 1:
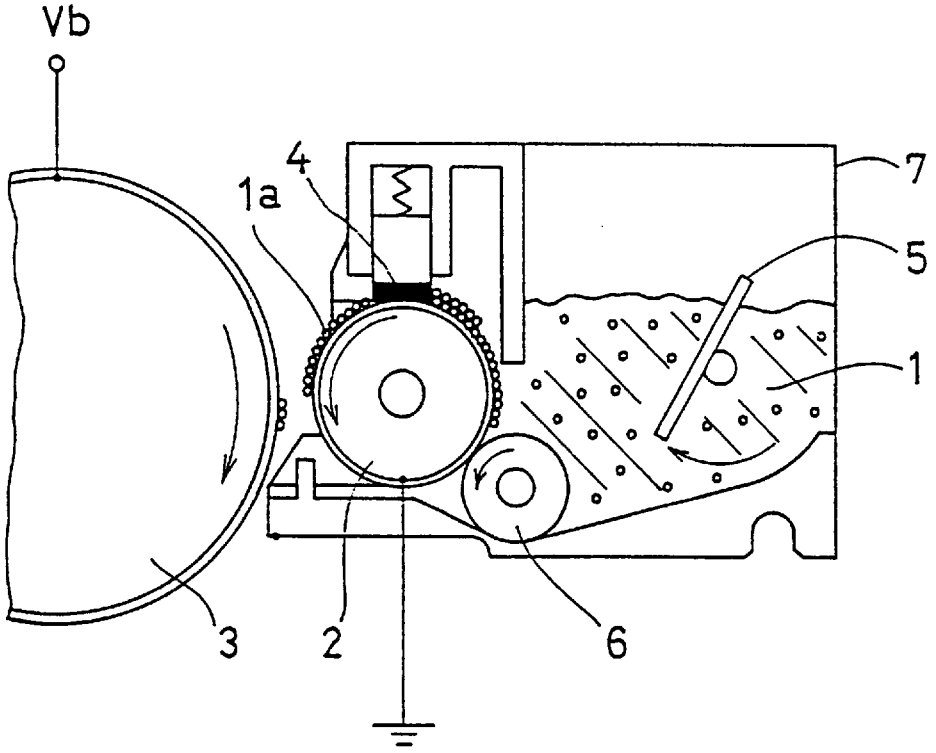
FIG. 1 is a section view showing a schematic structure of one embodiment of a developing unit applied with a toner of the present invention and to a non-contact developing method using the same.

The present invention provides a toner which can exhibit 5 nN or less of inter-particle force calculated by the following equation (1) when it is laminated and carried on a toner carrier:

$$Fv=q\cdot E-Fi \quad (1)$$

where Fv is an inter-particle force, q-E is a Coulomb force calculated by the following equation:

$$q\cdot E=q\cdot\{Vb+(Q/M)\cdot\delta\cdot P\cdot dt_1^2/(2\epsilon o\ \epsilon_T)\}/(\epsilon_T\cdot g+dt_1) \quad (2)$$

where Fi is an image-force calculated by the following equation (3):

$$Fi=\{(W_1\cdot\pi d^3\cdot\delta)/(6\ \epsilon o\ \epsilon_T)\}\cdot(Q/M)^2 \quad (3)$$

where q is a quantity of charge [C] of the toner particle to be developed, E is an electric field strength [V/m] acting on the toner layer, Q/M is a charge-to-mass ratio [$\mu$C/g] of the toner, $W_1$ is an amount of toner [mg/cm$^2$] separated by development among the toner laminated and carried on the toner carrier, εo is a vacuum dielectric constant [C/(V·m)], $\epsilon_T$ is an apparent specific dielectric constant [C/(V·m)] of the toner layer, d is an average particle size [$\mu$m] of the toner, δ is a true density [g/cm$^3$] of the toner, g is a gap [mm] between the outermost surface of the toner on the toner carrier and the electrostatic latent image holder, $dt_1$ is a thickness [μm] of the toner layer on the toner carrier, Vb is a development bias voltage [V] and P is a toner packing rate, and a non-contact developing method using the same.

According to the present invention, the toner whose inter-particle force calculated by the above equation (1) is 5 nN or less when it is laminated and carried on the toner carrier is formed. The inter-particle force Fv expressed by the equation (1) may be obtained by measuring numerical values to be substituted into the equations (2) and (3) and by substituting those measured values into them.

It is noted that a developer of the present invention may be either a monocomponent or a two-component developer.

While the monocomponent developer is composed of a toner only, the two-component developer is composed of a toner and a carrier (e.g. Iron powder, ferrite powder, magnetite powder, etc.).

In the case of the two-component developer, the electrical adhesive force includes the Coulomb force between the toner and the carrier in addition to the image-force, so that it can be calculated by $Fv=q\cdot E-Fi$ by defining the resultant force anew as Fi.

Among them, the monocomponent developer is preferable from the aspect that it allows toner images to be superimposed without color mixture and facilitates maintenance. Hereinafter, the monocomponent developer will be explained.

The monocomponent developer usable in the present invention is composed of a toner only which is mainly composed of a binder resin and contains optionally a colorant, an internal additive and an external additive.

The binder resin usable in the present invention is not limited to specific ones and any known materials such as those listed below may be used: styrene homopolymers such as polystyrene, poly-p-chlorostyrene, polyvinyl toluene; styrene copolymers such as styrene-p-chlorostyrene copolymer, styrene-propylene copolymer, styrene-vinyltoluene copolymer, styrene-vinylnaphthalene copolymer, styrenemethyl acrylate copolymer, styrene-ethyl acrylate copolymer, styrene-butyl acrylate copolymer, styrene-octyl acrylate copolymer, styrene-methyl methacrylate copolymer, styreneethyl methacrylate copolymer, styrene-butyl methacrylate copolymer, styrene-a-methyl chloromethacrylate copolymer, styrene-acrylonitrile copolymer, styrene-vinylmethylether copolymer, styrene-vinylethylether copolymer, styrene-vinylmethylketone copolymer, styrene-butadiene copolymer, styrene-isopropylene copolymer, styrene-maleic acid copolymer, styrene-maleate copolymer; and styrene terpolymers such as styrene-acrylonitrile-indene terpolymer.

Besides them, polymethylmethacrylate, polybutylmethacrylate, polyvinylchloride, polyvinylacetate, polyethylene, polypropylene, polyurethane, polyamide, epoxy resin, polyvinyl butyral, polyacrylic acid resin, rosin, denaturated rosin, terpene resin, phenolic resin, aliphatic or alicyclic hydrocarbon resin and aromatic petroleum resin may be listed up. Those binder resins may be used solely or in a mixture.

The colorants usable in the present invention are not limited to specific ones and any known materials such as those listed below may be used: carbon black, phthalocyanine blue, indanthrene blue, peacock blue, permanent red, lake red, rhodamine lake, Hansa yellow, permanent yellow and benzidine yellow.

The internal additives usable in the present invention include a charge control agent, a filler and others. Among them, the charge control agent is not limited to a specific one and any known agent such as those listed below may be used: negative charge control agents such as metal complex salt compound and positive charge control agents such as azine pigment and alkylammonium compound.

Examples of the external additives usable in the present invention include fluidizing agents such as aliphatic carboxylates and cleaning agents such as higher fatty acids.

Further, in order to weaken the inter-particle force among the toner particles and to reduce the inter-particle force (adhesive force) Fv at the section of flying portion of the toner layer on the toner carrier to 5 nN or less, inactive micro particles may be dispersed as spacers among the toner particles. The inactive micro particle may be, for example, a silica powder. Preferably, the particle has 0.01 μm to 1 μm of size. The particle having a size of less than 0.01 μm is not preferable because it is less effective in reducing the inter-particle force among the toner. Also, the particle having a size more than 1 μm is not preferable because it is the size close to the toner particle and gives a bad influence on the image. It is noted that an external additive may be dispersed in the toner in advance or at the developing stage.

The toner used in the present invention may be produced by using a known method. That is, a homogeneously dispersed matter of the above-mentioned binder resin, the colorant and the internal additive is formed under melting and kneading processes. Then, the dispersed matter is cooled and is ground so as to have a predetermined particle size in a grinding process. It is also subjected to a classification process to remove big and fine particles to obtain a toner having the predetermined average particle size.

Here, the average particle size of the toner is preferably within the range of 5 μm to 11 μm. Preferably, it is not less than 5 μm because otherwise the flying quality of the toner will decrease and the developability will be lowered due to the reduction of the Coulomb force acting on the toner and to the increase of the image-force. Preferably, it is not more than 11 μm because otherwise the resolution and tone reproduction will be lowered.

Accordingly, the toner having the following properties is preferable for the non-contact development.

The inter-particle force of the toner is preferably within the range of 0.01 nN to 5 nN because the flying quality is increased thereby.

The average particle size of the toner is preferably within the range of 5 μm to 11 μm because less reverse polarity toner is produced thereby.

The toner preferably contains inactive particles having 0.01 μm to 1 μm of average particle size as spacers because the inter-particle force is decreased thereby.

The toner charge-to-mass ratio is preferably within the range of 5 μC/g to 15 μC/g because the optimum Coulomb force can be obtained thereby.

The toner preferably has an average particle size within the range of 5 μm to 11 μm and the charge-to-mass ratio within the range of 5 μC/g to 15 μC/g because the optimum Coulomb force can be obtained thereby without producing the reverse polarity toner.

The toner laminated and carried on the toner carrier preferably has a thickness within the range of about 5 μm to 20 μm and a packing density thereof within the range of about 0.4 g/cm$^3$ to 0.85 g/cm$^3$ because the developability is enhanced thereby.

The toner preferably has a charge-to-mass ratio within the range of 5 μC/g to 15 μC/g, the thickness of the toner laminated and carried on the toner carrier within the range of about 5 μm to 20 μm and a packing density within the range of about 0.4 g/cm$^3$ to 0.85 g/cm$^3$ because the developability is enhanced thereby.

The toner is preferably an image forming toner mainly composed of a binder resin and containing optionally a colorant, an internal additive and an external additive because it can be produced by the known method.

The toner is preferably a non-magnetic monocomponent toner because it allows the toner images to be superimposed without color mixture and facilitates maintenance.

The toner is preferably formed into the predetermined average particle size by melting, kneading and grinding processes because it allows an image quality having good tone reproduction to be obtained.

The invention also provides a non-contact developing method which comprises flying-developing any one the toners described above to an electrostatic latent image holder so that the toner exhibits an inter-particle force of 5 nN or less when it is laminated and carried on a toner carrier, in a developing unit providing at least a toner carrier for laminating and carrying a charged toner as a developer, an electrostatic latent image holder disposed so as to face the toner carrier with a gap and an electric field applying and controlling means for applying and controlling an electric field between the toner carrier and the electrostatic latent image holder.

This non-contact developing method allows a stable flying-development to be realized only by the means for controlling the electrostatic force and field strength acting on the toner and allows an image quality having good tone reproduction to be obtained.

In the non-contact developing method in which the toner exhibits an inter-particle force of 5 nN or less when it is laminated and carried on the toner carrier, it is preferable that the field applying and controlling means is constructed so that it controls the toner charge-to-mass ratio so as to satisfy the following inequality (4):

$$5\ \mu C/g \leqq Q/M \leqq (\epsilon o\ \epsilon_T/W_1)\cdot E \quad (4)$$

where E is the electric field strength [V/m] acting on the toner layer, Q/M is the charge-to-mass ratio [$\mu$C/g] of the toner, $W_1$ is an amount of toner [mg/cm$^2$] to be separated by the development among the toner laminated and carried on the toner carrier, $\epsilon o$ is the vacuum dielectric constant [C/(V·m)] and $\epsilon_T$ is the apparent specific dielectric constant [C/(V·m)].

Accordingly, when the field applying and controlling means described above is constructed so that it controls the toner charge-to-mass ratio so as to satisfy the above inequality (4), the optimum Coulomb force may be obtained, thus improving the developability or the like.

For example, when the amount of toner to be separated by the development is $W_1$=0.3 [mg/cm$^2$] and when an electric field of E=2.5×10$^6$ (V/m) is applied to a toner layer having an apparent specific dielectric constant $\epsilon_T$=2, the range of the charge-to-mass ratio Q/M of the toner is found to be $5 \leqq Q/M \leqq 14.8$ ($\mu$C/g) according to the inequality (4), so that the composition (property) of the toner and a toner charging mechanism are designed targeting at those values. Alternatively, it is also possible to determine the toner charge-to-mass ratio in advance by setting the toner composition and the charging mechanism and then to set the electric field strength E of the toner layer so as to satisfy the inequality (4). The electric field strength E which acts on the toner layer varies depending on the developing conditions such as the potentials of the latent image and the toner carrier, the thickness of the toner layer laminated and carried on the toner carrier and the gap between the toner carrier and the electrostatic latent image holder, so that those values should be controlled so that an adequate field strength E is brought about.

Further, in the non-contact developing method in which the toner exhibits an inter-particle force of 5 nN or less when the toner is laminated and carried on the toner carrier, it preferably comprises peripheral speed ratio control means for controlling a ratio of the peripheral speeds of the toner carrier and the electrostatic latent image holder so that the ratio satisfies the following inequality (5):

$$W_{D \leqq W1}\cdot k \leqq W_R \quad (5)$$

where the toner carrier and the electrostatic latent image holder move in the same direction, k is the ratio of peripheral speeds of the toner carrier and the electrostatic latent image holder, $W_R$ is a toner mass per unit area [mg/cm$^2$] on the toner carrier for carrying the toner, $W_1$ is an amount of toner [mg/cm$^2$] to be separated by development among the toners laminated and carried on the toner carrier and $W_D$ is a required amount to be developed [mg/cm$^2$].

Accordingly, when the peripheral speed ratio control means is controlled so that the ratio of peripheral speed satisfies the above inequality (5), the development density can be assured while preventing the edge enhancement.

A relation of $W_1 < W_D$ means that the amount of toner $W_1$ separated from the toner carrier by the development is short from the required amount to be developed WD and it occurs when a toner is used whose average charge-to-mass ratio Q/M is large or toner whose adhesive force is large, thus having an inferior developability.

When the toner having a large charge-to-mass ratio is used in the inequality (4) for example, it is necessary to increase the right side of the inequality (4)=$\epsilon o\ \epsilon_T \cdot E/W_1$. However, the enhancement of the specific dielectric constant $\epsilon_T$ and the field strength E which acts on the toner is limited in the right side of the inequality (4) and therefore, the amount of toner $W_1$ separated by the development becomes small inevitably.

Accordingly, it is not enough to have the amount of toner $W_1$ separated from the toner carrier to assure the required amount to be developed by using the toner having the large charge-to-mass ratio and it becomes necessary to increase the total amount to be developed by increasing the peripheral speed of the toner carrier more than that of the electrostatic latent image holder.

When the peripheral speed of the toner carrier is faster than that of the electrostatic latent image holder (i.e. When the ratio of peripheral speed satisfies k>1), the ratio of peripheral speed k and the toner mass per unit area $W_R$ need to be set so as to satisfy the inequality (5) to prevent the edge enhancement and to assure the development density and a developing unit which satisfies both of the inequalities (4) and (5) becomes necessary.

Then, it is preferable to arrange the field applying and controlling means so that the toner charge-to-mass ratio satisfies the inequality (4) and to arrange the peripheral speed ratio control means so that the ratio of the peripheral speeds of the toner carrier and the electrostatic latent image holder satisfies the inequality (5) in the non-contact developing method in which the inter-particle force of the toner exhibits 5 nN or less when the toner is laminated and carried on the toner carrier.

It is noted that the electric field applying and controlling means is composed of a DC or AC high voltage generating circuit, an electrical field controlling circuit and others. The electric field applied between the toner carrier and the electrostatic latent image holder may be either DC or AC.

The peripheral speed ratio control means comprises a motor driving circuit, a speed controlling circuit (including a speed detecting circuit and a peripheral speed setting circuit) and others and is controlled by a microcomputer.

The present invention will now be explained in detail based on the preferred embodiment shown in the drawings. It should be understood that the present invention is not limited to the embodiment.

FIG. 1 is a section view schematically showing a structure of one embodiment of a developing unit applied to the inventive toner and to the non-contact developing method using the same. It is noted that the developing unit shown in FIG. 1 is used also as a flying-development experimental equipment in the present invention. In the figure, nonmagnetic monocomponent toner 1 is filled in a hopper 7 and is supplied to a toner carrier (developing roller) 2 by a toner supplying member 6 while being agitated by a toner agitating member 5. The toner carrier 2 is made of an aluminum sleeve with 31.4 mm in diameter and 315 mm in length and is sandblasted with spherical particle so as to have a surface roughness of Ra=1 $\mu$m of center line average height.

The non-magnetic monocomponent toner 1 is charged by a contact and friction of the supplying member 6 and aluminum. The toner is carried on the toner carrier 2 and is charged again. A layer thereof is restricted when the toner passes through a blade 4 which charges and restricts the toner. A load of 1 kgf to 3 kgf is applied to the blade 4 so as to abut against the toner carrier 2. The toner charge-to-mass ratio is decided by the intrinsic chargeability of the toner, the material of the sleeve of the toner carrier 2 and a degree of friction between the toner and the roller. For example, the greater the load applied to the blade 4, the greater the charge-to-mass ratio becomes.

A drum 3 which is selected as the electrostatic latent image holder and which is 80 mm in diameter and 320 mm in length is disposed facing to the toner carrier 2 while keeping a certain gap (0.1 mm to 0.2 mm) therebetween. The toner on the toner carrier 2 is also kept in non-contact with the drum 3. The toner carrier 2 and the drum 3 rotate in a direction as indicated by an arrow in the figure with 175 mm/sec. of peripheral speed. The toner carrier 2 is grounded and a bias voltage Vb=−700 V which corresponds to a latent image potential is applied to the drum 3 only by time of one turn of the drum 3 by field controlling means not shown.

Here, the development bias voltage Vb becomes 0–(−700) V=700 V.

The experimental equipment comprises the field controlling means for applying a potential or DC electric field between the toner carrier 2 and the drum 3 and the toner charging means (the blade 4 and the toner supplying member 6) for charging the non-magnetic monocomponent toner. It is noted that means for injecting charge from a conductive electrode or corona discharge may be used as the means for charging the toner.

It further comprises peripheral speed ratio setting means (not shown) for setting the ratio k of the peripheral speeds k of the toner carrier 2 and the drum 3 and a motor speed controlling circuit (not shown) for driving the toner carrier 2 and the drum 3 counterclockwise and clockwise, respectively, at a constant speed with the set ratio of the peripheral speed. It also comprises adjusting means (not shown) for finely adjusting the gap between the toner carrier 2 and the drum 3.

Figure 2:
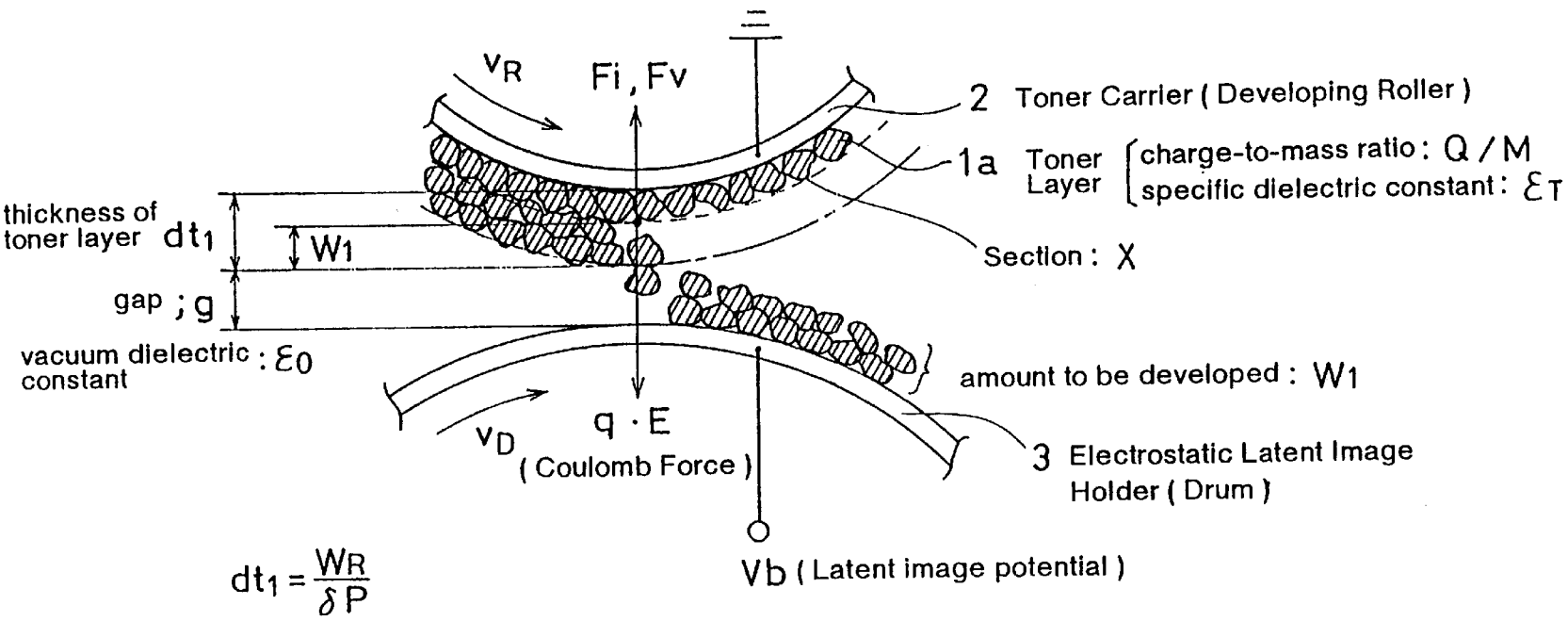
FIG. 2 is an enlarged view showing a non-contact developing section applied with a toner of the inventions and to the non-contact developing method using the same.

FIG. 2 is an enlarged view of a non-contact developing section applicable to the inventive toner and to the non-contact developing method using the same. At a section X of the inside of the toner layer 1*a* having a thickness $dt_1$ formed on the toner carrier 2 which is a metallic sleeve in the figure, the force in the flying direction is a Coulomb force q·E and the force which impedes the flying force is an image-force Fi and an inter-particle force Fv at the section X.

The section X can be found by measuring the thickness of the toner layer on the developing roller after the flying or the amount of flied toner (amount to be developed). For example, the use of a laser scanning microscope manufactured by Lasertec Corp. allows the thickness of the toner layer on the developing roller before and after the flying to be measured and then allows the section X to be found. The image-force Fi acting on the section may be calculated when the section X can be found.

Accordingly, the inter-particle force Fv can be found as a difference between the Coulomb force q·E and the image-force Fi at the section of the toner layer on the toner carrier based on the actual measurement of the amount of toner $W_1$ mg/cm$^2$ separated by development among the toners laminated and carried on the toner carrier from the following equations (1) through (3):

$$Fv=q\cdot E-Fi \tag{1}$$

$$q\cdot E=q\cdot\{Vb+(Q/M)\cdot\delta\cdot P\cdot dt_1^2/(2\epsilon o\ \epsilon_T)\}/(\epsilon_T\cdot g+dt_1) \tag{2}$$

$$Fi=\{(W_1\cdot\pi d^3\cdot\delta)/(6\ \epsilon o\ \epsilon_T)\}\cdot(Q/M)^2 \tag{3}$$

where Fv is the inter-particle force, q·E is the Coulomb force calculated by the equation (2), Fi is the image-force calculated by the equation (3), q is a quantity of charge [C] of the toner particle to be developed, E is an electric field strength [V/m] acting on the toner layer, Q/M is a charge-to-mass ratio [$\mu$C/g] of the toner, $W_1$ is an amount of toner separated by development among the toner laminated and carried on the toner carrier, $\epsilon o$ is a vacuum dielectric constant [C/(V·m)], $\epsilon_T$ is an apparent specific dielectric constant [C/(V·m)] of the toner layer, d is a particle size [$\mu$m] of the toner, $\delta$ is a true density [g/cm$^3$] of the toner, g is a gap [mm] between the outermost surface of the toner on the toner carrier and the electrostatic latent image holder, $dt_1$ is a thickness [$\mu$m] of the toner layer on the toner carrier, Vb is a development bias voltage [V] and P is a toner packing rate. It is noted that the toner packing rate P and the apparent specific dielectric constant $\epsilon_T$ can be found by using the equations (6) through (9) described below.

A method for obtaining the apparent specific dielectric constant $\epsilon_T$ of the toner layer will now be explained. First it is necessary to know the packing rate of the toner layer P having a void in order to find the apparent specific dielectric constant $\epsilon_T$ of the toner layer. The packing rate P can be obtained by using measurements of the surface potential Vt, the toner charge-to-mass ratio Q/M and the toner mass per unit area w as follows.

The surface potential Vt, the toner average charge-to-mass ratio Q/M and the toner mass per unit area w of the toner layer 1*a* on the toner carrier 2 after passing through the blade 4 were measured in the experimental equipment shown in FIG. 1.

The surface potential Vt of the toner layer can be expressed as follows:

$$Vt=W^2\cdot(Q/M)/[(2\ \epsilon o\ \{1+P(\epsilon t-1)\}\delta\cdot P] \tag{6}$$

Rearranging the equation (6) with respect to P gives the following equation as a quadratic equation of P:

$$(\epsilon t-1)\ P^2+P-W^2\cdot(Q/M)/(2\ \epsilon o\ \delta Vt)=0 \tag{7}$$

Solving the equation (7) with respect to P gives the following equation:

$$P=[\{1+2(\epsilon t-1)\cdot W^2\cdot(Q/M)/(\epsilon o\ \delta Vt)^{1/2}-1]/\{2(\epsilon t-1)\} \tag{8}$$

Accordingly, substituting the measurements of Vt, Q/M and w into the equation (8) gives the packing rate P, thus allowing to obtain the apparent specific dielectric constant $\epsilon_T$ from the following equation:

$$\epsilon_T=1+P(\epsilon t-1) \quad (9)$$

The actually measured values and the relational equations described above allow to verify whether the inter-particle force of the toner laminated and carried on the toner carrier is 5 nN or less.

Accordingly, it becomes possible to screen the toner having less inter-particle force Fv by the toner flying experiment at a testing bench without performing any copying test and to find the property and formula of the non-magnetic monocomponent toner which attains the non-contact development efficiently.

It is noted that although the development bias voltage has been set at the same value as the latent image potential in the present embodiment, the development bias voltage may have a value different from that of the latent image potential. That is, because the inter-particle force Fv can be found from the amount of separated toner $W_1$ with respect to the development bias voltage Vb, the development bias voltage Vb can take a voltage value between a development starting voltage and a development saturation voltage.

When the experiment of the non-contact development was performed by regulating the inter-particle force of the toner which is an adhesive force other than the electrostatic force to 5 nN or less in the experimental equipment described above, it was found that there exist solutions which allow the development regardless of the toner particle size and even with a toner having a large charge-to-mass ratio (see the Table in FIG. 12).

It was also found that the range of the charge-to-mass ratio Q/M which allows the non-contact development at that time can be controlled only by the electrostatic force so that the following inequality (4) is satisfied:

$$5\ \mu C/g \leqq Q/M \leqq (\epsilon o\ \epsilon_T/W_1)\cdot E \quad (4)$$

where E is a field strength [V/m] acting on the toner layer, Q/M is a charge-to-mass ratio [$\mu$C/g] of the toner, $W_1$ is an amount of toner [mg/cm$^2$] to be separated by the development among the toner laminated and carried on the toner carrier, $\epsilon o$ is the vacuum dielectric constant [C/(V·m)] and $\epsilon_T$ is an apparent specific dielectric constant [C/(V·m)].

A process for deriving the inequality (4) will be explained below. It was found, when the electric field acting on the toner layer and the development gap (the gap between the outermost surface of the toner on the toner carrier and the electrostatic latent image holder) was analyzed, that the flying amount (amount to be developed) per unit area can be expressed by the following equation (10):

$$M/A=\{^6\epsilon o\cdot\epsilon_T/(\pi d^3\delta)\}\cdot[\{(\pi d^3\delta/6)\cdot(Q/M)\cdot E-Fv\}/(Q/M)^2] \quad (10)$$

E in the equation (10) represents the field strength acting on the toner layer and is expressed as follows:

$$E=\{Vb+(Q/M)\cdot\delta\cdot P\cdot dt_1^2/(^2\epsilon o\ \epsilon_T)\}/(\epsilon_T\cdot g+dt_1) \quad (11)$$

where so is the vacuum dielectric constant [$8.85\times10^{-12}$ C/(V·m)], ET is an apparent specific dielectric constant of the toner layer, d is the particle size of the toner, $\delta$ is a true density of the toner, Q/M is a toner charge-to-mass ratio (quantity of charge per unit mass), Fv is an inter-particle force of the toner, i.e., a flying restricting force other than the image-force at the flying section, $dt_1$ is a thickness of the toner on the toner carrier, Vb is a development bias voltage, P is a toner packing rate and g is the gap between the outermost surface of the toner on the toner carrier and the electrostatic latent image holder.

The apparent specific dielectric constant $\epsilon_T$ of the toner layer within the equations (10) and (11) can be obtained by the specific dielectric constant Ft intrinsic to the toner and the packing rate P of the toner layer from the equation described above:

$$\epsilon_T=1+P(\epsilon t-1) \quad (9)$$

By the way, the condition in which the amount to be developed M/A is greater than $W_1$ can be expressed as follows:

$$W_1 \leqq M/A=\{^6\ \epsilon o\ \epsilon_T/(\pi d^3\delta)\}\cdot[\{(\pi d^3\ \delta/6)\cdot(Q/M)\cdot E-Fv\}/(Q/M)^2] \quad (12)$$

Because it can be assumed that Fv≅0 when the inter-particle force Fv is sufficiently small, the minimum requirement in which the amount to be developed M/A is greater than $W_1$ is expressed as follows by setting as Fv=0 in the inequality (12):

$$(Q/M)\cdot\{W_1\ (Q/M)-\epsilon o\ \epsilon_T\cdot E\} \leqq 0 \quad (13)$$

Accordingly, the range of Q/M which satisfies the inequality (13) may be obtained from the following inequality:

$$0 \leqq Q/M \leqq (\epsilon o\ \epsilon_T/W_1)\cdot E \quad (14)$$

The inequality (14) is the requirement for obtaining the amount to be developed M/A in the flying-development.

Because the electric field acting on the toner layer expressed by the equation (11) can be approximated as follows when the thickness $dt_1$ of the toner layer is small as compared to the gap g:

$$E \cong Vb/(\epsilon_T\cdot g)=Eg/\epsilon_T \quad (15)$$

(Where Eg is the electric field of the gap; Eg=Vb/g), the inequality (14) can be simplified as follows:

$$0 \leqq Q/M \leqq \epsilon o\cdot Eg/W_1 \quad (16)$$

It is noted that the equations described above are applicable regardless of the polarities of the toner. That is, negatively charged toner may be used by letting the absolute value thereof to satisfy the above-mentioned inequality.

Figure 3:
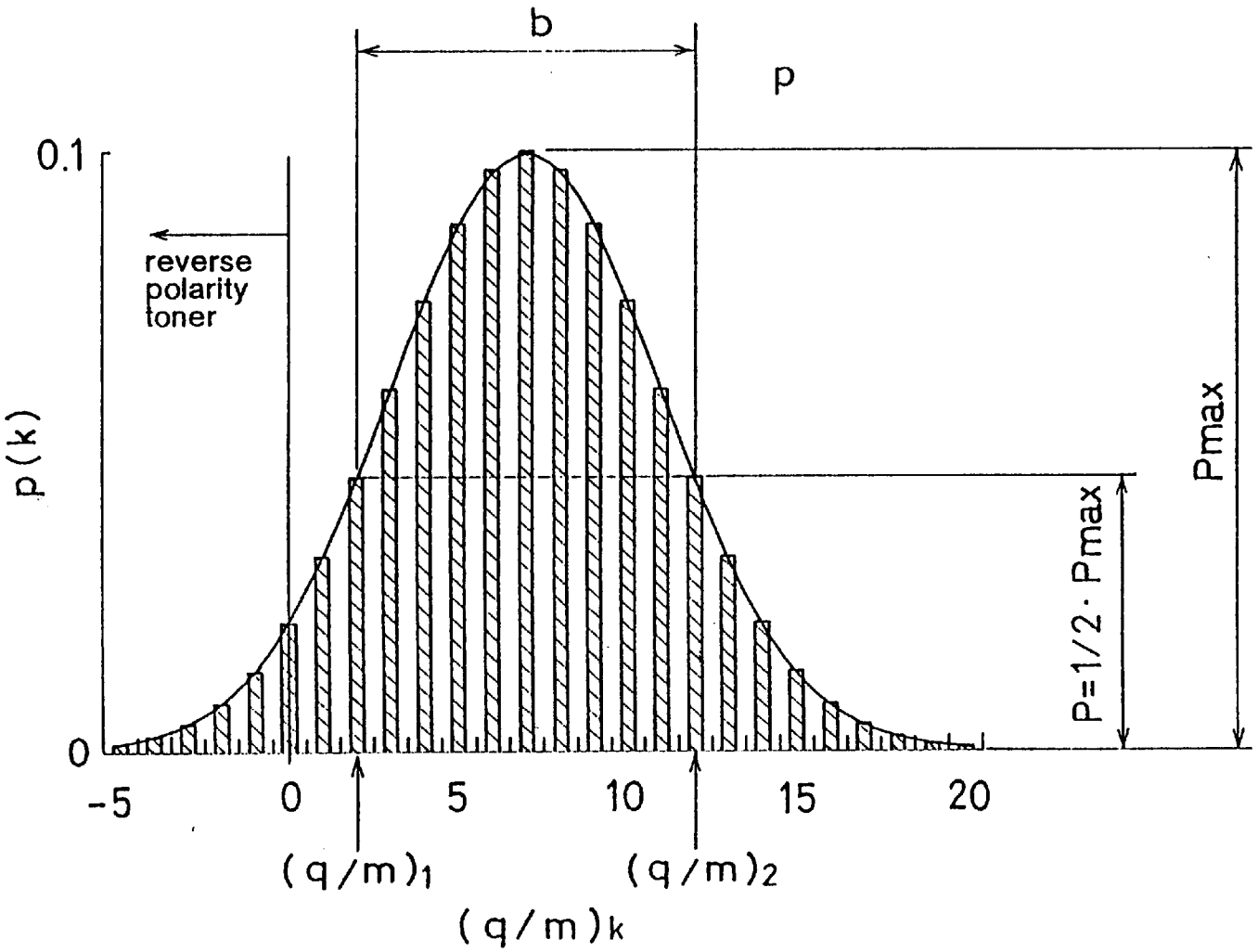
FIG. 3 is a graph showing a toner charge distribution of the invention.

Next, the lower limit value of the charge-to-mass ratio (Q/M) in the equation (4) and the rate of the reverse polarity toner will be explained. The toner laminated on the toner carrier has a charge distribution. FIG. 3 is a graph showing the toner charge distribution. In the figure, the horizontal axis represents the charge-to-mass ratio (q/m)k Of the toner particle and the vertical axis represents a rate of frequency p(k) of the toner particle having the charge-to-mass ratio (q/m)k.

Assume here a half-value width b of the distribution as a scale showing the divergence of the charge distribution. The half-value width b is a difference between the values of charge-to-mass ratio $(q/m)_1$ and $(q/m)_2$ when the rate of frequency p becomes half of the maximum rate of frequency p max, i.e., $(q/m)_1-(q/m)_2$.

While the half-value width b does not change so much when the average value Q/M (Q/M=Σ((q/m)k·p(k)) of the charge-to-mass ratio (q/m)k of the toner changes, the distribution thereof is shifted in the X-axis direction when Q/M changes. In such a distribution, the rate of the number of reverse polarity toner RN is (the total number of toner particles with reverse polarity)/(the total number of all the toner particles), and a voluminal rate of reverse polarity toner $R_V$ is (total volume of toner particle with reverse charge)/(the total volume of all the toner particles).

In the toner whose Q/M is 5 ($\mu$C/g) or less, both the rate of the number of reverse polarity toner $R_N$ and the voluminal rate of the reverse polarity toner $R_V$ reach around to 10%, causing a background fog and producing images having less sharpness. On the other hand, in toner whose Q/M is greater than 5 ($\mu$C/g), both the $R_N$ and $R_V$ take values less than 10%, producing images less deteriorated. Accordingly, the lower limit value of the Q/M is 5 ($\mu$C/g).

Setting the inter-particle force of the toner to 5 nN or less and the charge-to-mass ratio Q/M of the toner within the range of the inequality (4) described above, i.e., 5 ($\mu$C/g) $\leqq Q/M \leqq (\epsilon o\ \epsilon_T/W_1)\epsilon E$, when the toner is laminated and carried on the toner carrier as described above allows the development in non-contact because a desirable amount of toner among the toners laminated on the toner carrier is desorbed from the toner carrier by the electrostatic force, thus providing a non-contact developing unit in which the rate of the reverse polarity toner is small and which provides images having excellent sharpness even if the charge-to-mass ratio is more or less higher as compared to the past.

In the non-contact development, the toner laminated and carried on the toner carrier does not fly to the electrostatic latent image holder by 100%, so that there is a method of increasing the peripheral speed of the toner carrier (developing roller) more than that of the electrostatic latent image holder (photographic drum) as means for increasing the amount of toner to be developed on the electrostatic latent image holder.

However, when the peripheral speed of the toner carrier is increased, density of the edge portion may be emphasized depending on the development pattern, so that it is necessary to control the ratio of the peripheral speeds of the toner carrier and the electrostatic latent image holder adequately.

The range of the ratio of the peripheral speed k which allows the non-contact development in such a case and allows a predetermined amount of toner to be developed to be obtained without causing the emphasis of edge density is obtained by controlling the speeds so as to satisfy the following inequality:

$$W_D \leqq W_1 k \leqq W_R \tag{5}$$

where the toner carrier and the electrostatic latent image holder move in the same direction, k is the ratio of peripheral speeds of the toner carrier and the electrostatic latent image holder, $W_R$ is a toner mass per unit area [mg/cm$^2$] on the toner carrier for carrying the toner, $W_1$ is an amount of toner [mg/cm$^2$] to be separated by development among the toner laminated and carried on the toner carrier and $W_D$ is a required amount to be developed [mg/cm$^2$].

When the moving speed of the toner carrier is twice that of the electrostatic latent image holder, the amount of the toner $W_1$ [mg/cm$^2$] separated by the development among the toner laminated and carried on the toner carrier is doubled and about 2 $W_1$ [mg/cm$^2$] of the toner can be obtained. However, in the case of the non-magnetic monocomponent toner, the toner onto the toner carrier is apt to be depleted because the amount of toner capable of adhering onto the toner carrier is less than that of the magnetic toner or the two-component developer.

Especially when the latent image pattern changes from a non-developing portion to a developing portion seen from the side of the toner carrier, there arises an edge-emphasized development in which the development density is high in the developing portion to be developed first (especially the boundary area of the non-developing portion and the developing portion, i.e., the latent image edge portion) because sufficient toner exists on the toner carrier and the density becomes low in the area other than that.

The experiment showed that the location where the edge enhancement arises and the degree thereof are influenced by the orientation and the rate of the relative speed of the electrostatic latent image holder with respect to the toner carrier. This mechanism will be explained below.

Figure 4:
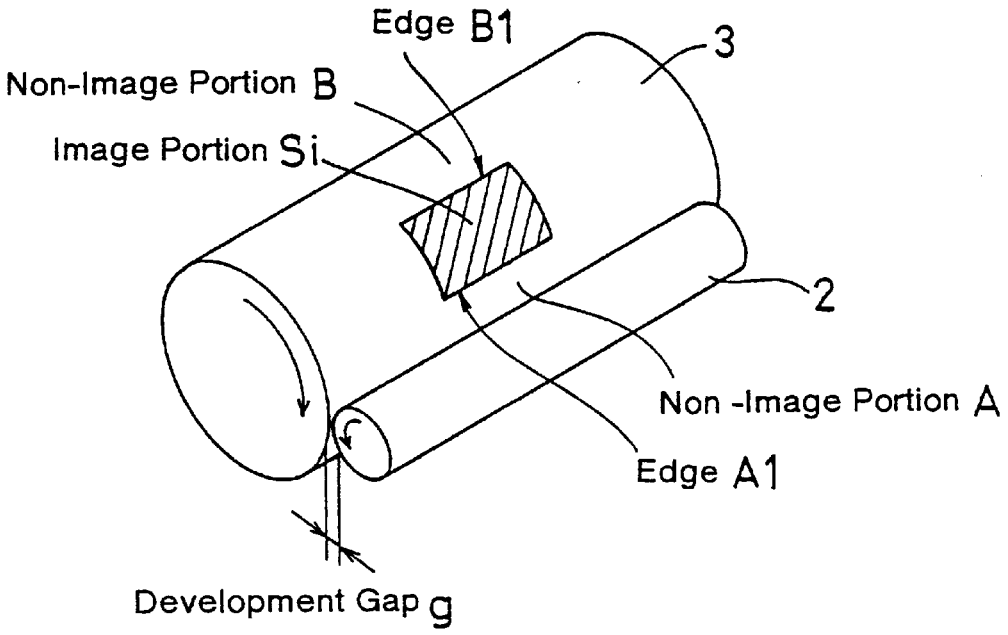
FIG. 4 is a perspective view for explaining an area where an edge-emphasized image is generated.
Figure 5:
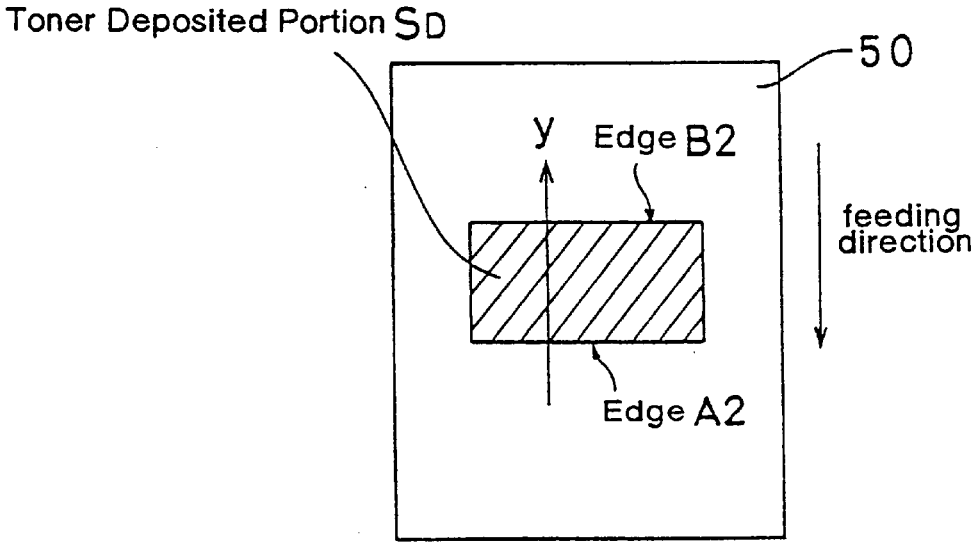
FIG. 5 is a drawing for explaining the edge-emphasized image on a recording sheet.
Figure 6:
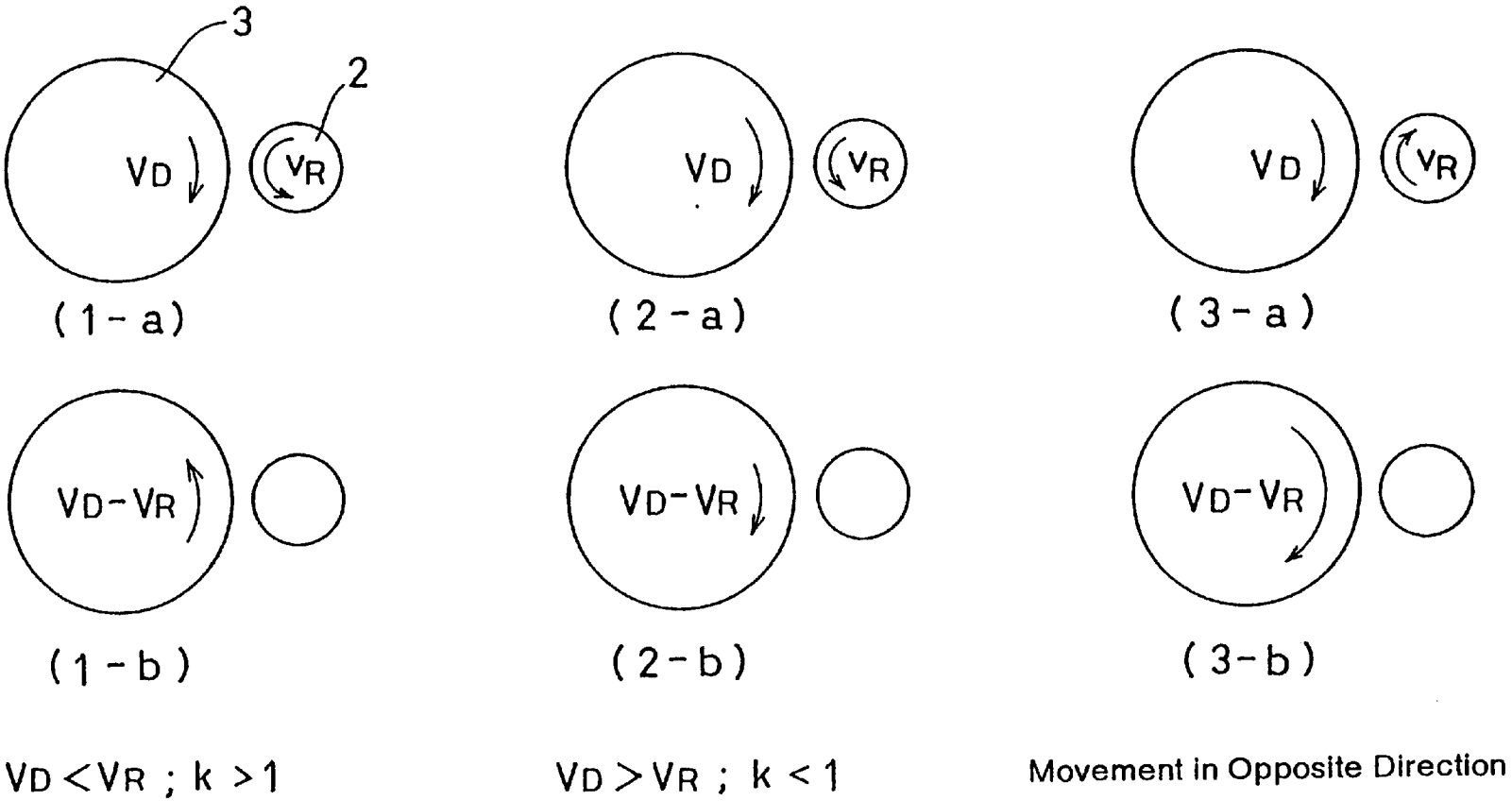
FIG. 6 is a drawing for explaining the directions of rotation and the peripheral speeds of a toner carrier and an electrostatic latent image holder.

FIG. 4 is a drawing showing an area where the edge emphasized image is created, FIG. 5 is a drawing showing the edge emphasized image on a recording sheet and FIG. 6 is a drawing showing directions of the rotation and the relationships of the rates of the peripheral speed of the toner carrier and the electrostatic latent image holder.

In FIG. 4, the reference character Si denotes the image portion (developed portion) on the drum 3, and A and B denote non-image portions (non-developed portions). $S_D$ in FIG. 5 denotes a toner-deposited portion when this development pattern is transferred and fixed to the recording sheet 50.

When the drum 3 rotates clockwise and the toner carrier 2 rotates counterclockwise as shown in FIG. 4, the moving directions of the both are the same and downward at the developing section.

When the ratio of the peripheral speed satisfies k>1 as shown in FIG. 6, i.e., when the peripheral speed $V_D$ of the electrostatic latent image holder 3 is less than the peripheral speed $V_R$ of the toner carrier 2, the orientation of the relative speed $V_D - V_R$ of the electrostatic latent image holder 3 with respect to the toner carrier 2 is counterclockwise as shown in FIG. 6 (1-*b*). As a result, the edge B1 which is a boundary of the non-image portion B and the image portion Si encounters with the toner on the developing roller first and the development density thereof is increased. Thereby, an edge B2 on the recording sheet 50 is emphasized.

When the moving directions of the electrostatic latent image holder 3 and the toner carrier 2 are the same and the ratio of the peripheral speed is k<1 and when the moving directions of the electrostatic latent image holder 3 and the toner carrier 2 are opposite, the relative speed $V_D - V_R$ is clockwise as shown in FIG. 6 (2-*b*) and an edge A1 of the boundary of the non-image portion A and the image portion Si is developed first. Accordingly, the development density of the edge A1 is enhanced and the edge A2 on the recording sheet 50 is emphasized.

The developing condition should meet the inequality (5) to prevent the edge enhancement. For example, when the required amount to be developed $W_D$ is 0.5 mg/cm$^2$, the amount of the toner $W_1$ separated by development among the toners laminated and carried on the toner carrier is 0.3 mg/cm$^2$ and the toner mass per unit area $W_R$ on the toner carrier is 0.8 mg/cm$^2$, it follows:

$$0.5 \leqq 0.3 \cdot k \leqq 0.8$$

and then $$1.67 \leqq k \leqq 2.67.$$

Accordingly, the ratio of the peripheral speed is set at a value between 1.67 and 2.67. Then, the edge enhancement can be prevented by defining a relational equation among the required amount to be developed $W_D$, the amount of toner $W_1$ separated by development among the toners laminated and carried on the toner carrier, the toner mass per unit area $W_R$ on the toner carrier and the moving directions and the ratio of the peripheral speed k of the toner carrier and the electrostatic latent image holder as described above.

Figure 7:
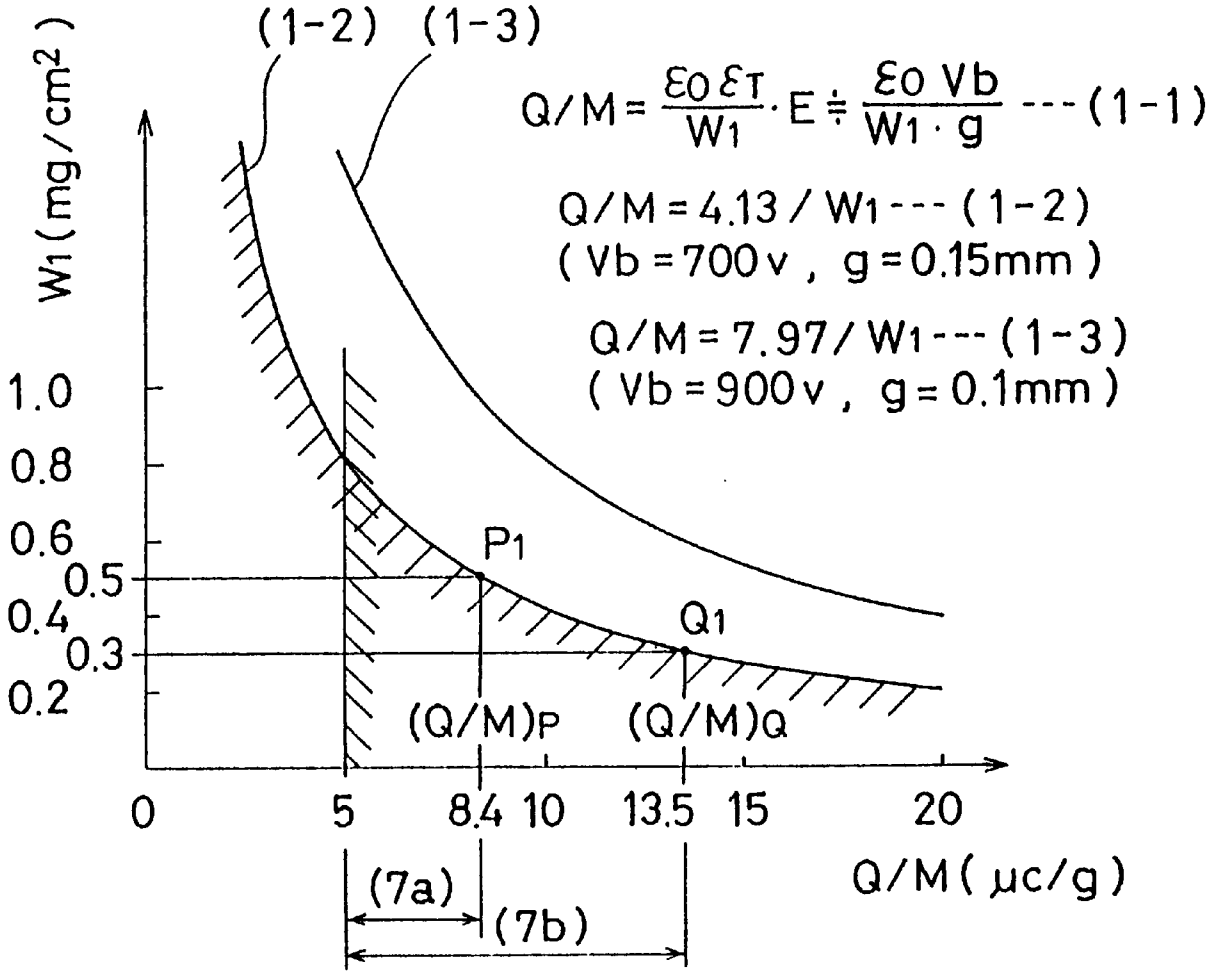
FIG. 7 is a graph for setting the range of a charge-to-mass ratio Q/M of a toner of the invention.

FIG. 7 is a graph for setting the range of the charge-to-mass ratio Q/m of the toner. In the figure, Y-axis represents $W_1$[mg/cm$^2$] and X-axis represents Q/M [$\mu$C/g].

$$Q/M=(\epsilon o\ \epsilon_T/W_1)\cdot E\cong(\epsilon o/W_1)\cdot(Vb/g) \quad (1\text{-}1)$$

When Vb=700 V (development bias voltage) and the gap g=0.15 mm, the graph is expressed as follows:

$$Q/M=4.13/W_1 \quad (1\text{-}2)$$

When Vb=900 V and g=0.1 mm, the graph is expressed as follows:

$$Q/M=7.97/W_1 \quad (1\text{-}3)$$

When $W_1$ is 0.5 mg/cm$^2$ in the equation (1-2), the value of Q/M is 8.4 $\mu$C/g and the allowable width of the charge-to-mass ratio is the range of $5 \leqq Q/M \leqq 8.4$ $\mu$C/g indicated by (7*a*) in FIG. 7. Because the required amount to be developed is 0.5 mg/cm$^2$ to 0.6 mg/cm$^2$, the non-contact developing method which satisfies the equation (4) is provided.

Next, the parameter setting process for setting the charge-to-mass ratio at 10 $\mu$C/g or more will be explained. The amount of the toner $W_1$ separated by development from the toner carrier under the condition of more than 10 mC/g of charge-to-mass ratio is less than 0.4 mg/cm$^2$ as can be seen from a curve (1-2) in the graph.

In a non-contact developing method wherein $W_1$ is set at 0.3 mg/cm$^2$, the upper limit of Q/M is 13.5 $\mu$C/g and the toner satisfying the inequality of $5 \leqq Q/M \leqq 13.5$ indicated by (7*b*) in FIG. 7 can be used, so that a developing unit having a large allowable width can be realized. At this time, it is essential that the inequality (5) is satisfied in order to supply the required amount to be developed.

Figure 8:
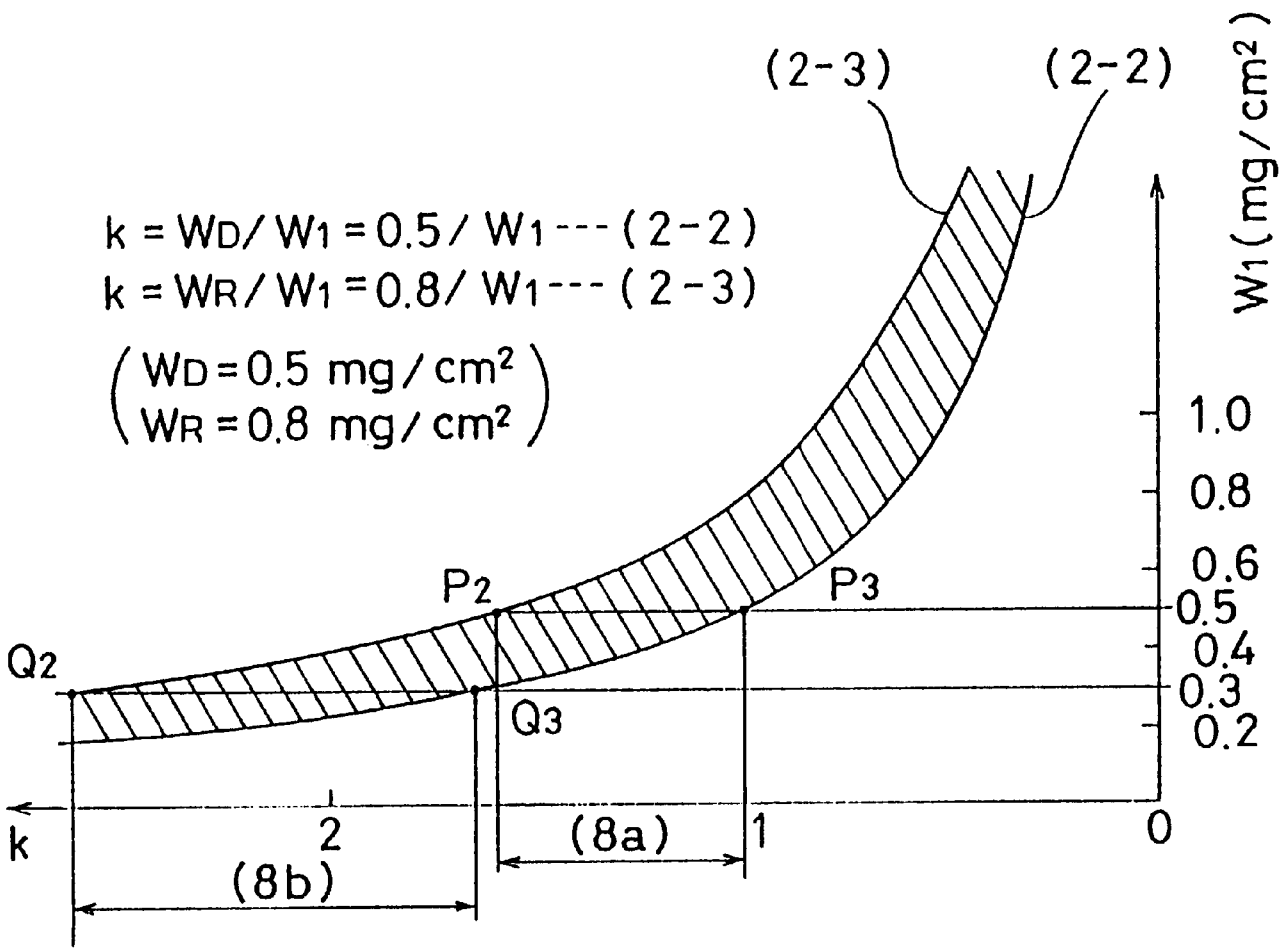
FIG. 8 is a graph for setting the ratio of peripheral speed k in accordance with the invention.

FIG. 8 is a graph for setting the range of the ratio of the peripheral speed k. In the figure, Y-axis represents $W_1$[mg/cm$^2$] and X-axis represents value of k.

$$W_D/W_1 \leqq k \leqq W_R/W_1 \quad (2\text{-}1)$$

When $W_D$=0.5 mg/cm$^2$ and $W_R$=0.8 mg/cm$^2$, $$K=W_D/W_1=0.5/W_1 \quad (2\text{-}2)$$

$$K=W_R/W_1=0.8/W_1 \quad (2\text{-}3)$$

When $W_1$=0.3 mg/cm$^2$, $1.67 \leqq k \leqq 2.67$. Accordingly, the toner having a large charge-to-mass ratio can be applied to the developing unit by satisfying the development condition of the inequality (5).

Therefore, while only the inequality (4) needs to be satisfied when the amount of toner $W_1$ separated by the development among the toners laminated and carried on the toner carrier has reached the required amount to be developed $W_D$, the inequality (5) should also be satisfied at the same time when the amount of toner $W_1$ is less than the required amount to be developed $W_D$. That is, the required amount to be developed can be assured even with the toner whose average charge-to-mass ratio is large or the toner whose adhesive force is relatively large and whose developability is bad by satisfying the inequalities (4) and (5) at the same time.

Then, it becomes possible to provide a developing unit which can avoid the edge enhancement and can assure the required amount to be developed even under the condition in which the amount to be developed per toner carrier is small.

In the non-contact developing method of the equation (4), the method for increasing the charge-to-mass ratio Q/M includes methods of controlling it by controlling the amount of the charge control agent added to the toner, methods of *enhancing the degree of the friction of the toner in the frictional charging mechanism or methods of injecting charge to the toner forcibly from the outside.

When the upper limit of the Q/M is to be increased by enhancing the electric field, a method of increasing Vb (development bias voltage: charge potential of photographic drum—potential of developing roller) or of reducing the developing gap g may be adopted.

For example, the curve of the equation (1-3) when Vb=900 V and the gap g=0.1 mm in FIG. 7 is shifted from the curve of the equation (1-2) when the Vb=700 V (development bias voltage) and g=0.15 mm to the side where the charge-to-mass ratio is larger. Accordingly, it allows the developing unit having a larger allowable width to be constructed.

One of the purpose of the present invention is to provide a method which allows a non-contact development even with a small size toner whose particle size is 11 $\mu$m or less. While it has been mentioned that the developability of the small size toner is low, the reason thereof will be explained below. While the condition required for the flying-development described above is a condition in which the inter-particle force Fv other than the image-force acting on the toner is reduced to zero and the equation (11) becomes independent of the particle size of the toner, the inter-particle force Fv actually has a certain value and the flying quality of the toner depends on the particle size.

Figure 9:
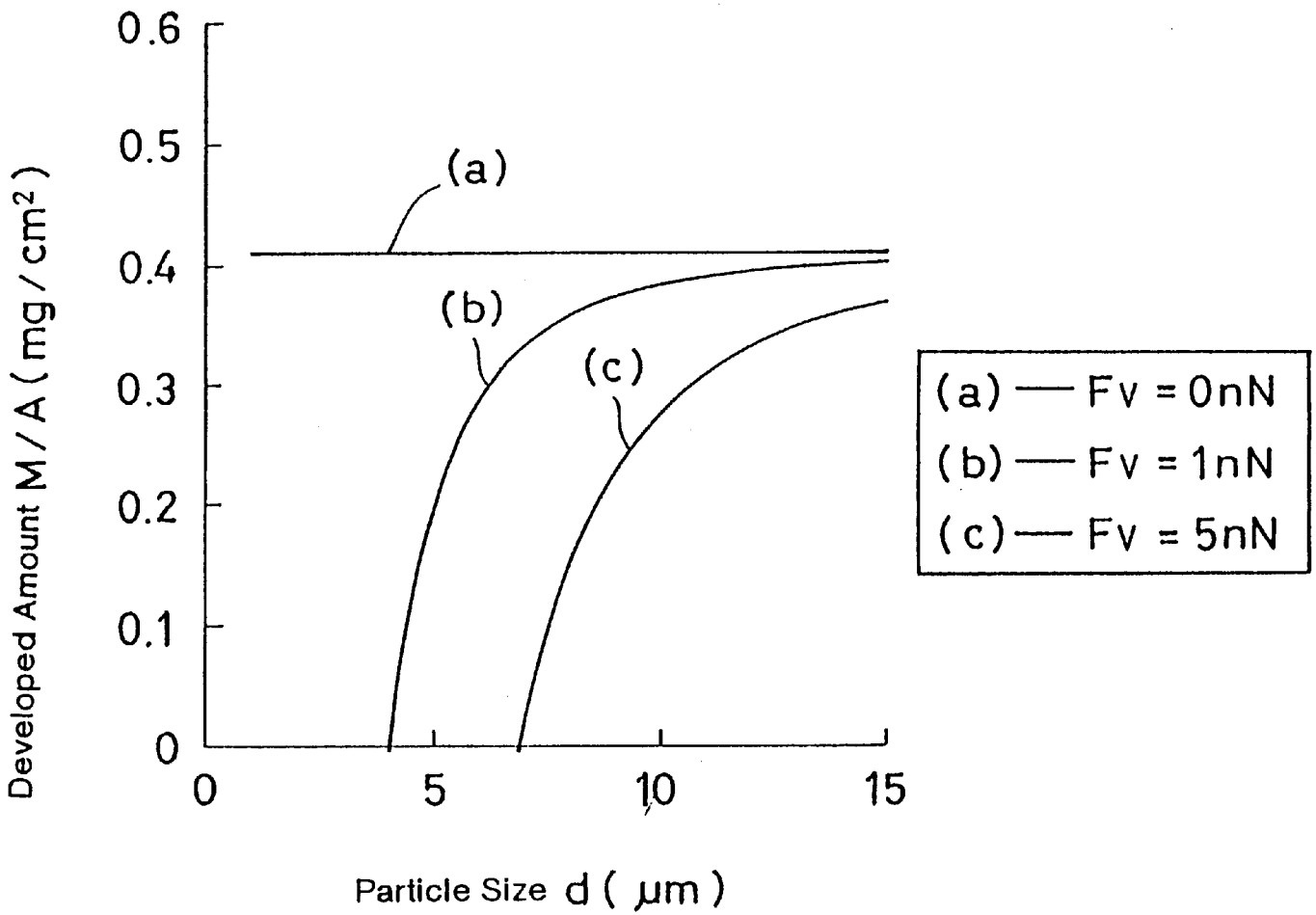
FIG. 9 is a graph showing relationship between the toner particle size d and the amount to be developed M/A with respect to the value of inter-particle force Fv in accordance with the invention.

For example, when the amount to be developed M/A is calculated by using the equation (10), the result turns out as shown in FIG. 9. Here, the smaller the particle size is the lower the flying property is. FIG. 9 is a graph showing a relationship between the particle size of the toner d and the amount to be developed M/A with respect to the inter-particle force Fv of the toner. When the allowable range of the charge-to-mass ratio which allows the development is calculated with respect to the inter-particle force Fv, the result turns out as shown in FIG. 10, which is a graph showing the allowable range of the charge-to-mass ratio Q/M with respect to the inter-particle force Fv.

Figure 10:
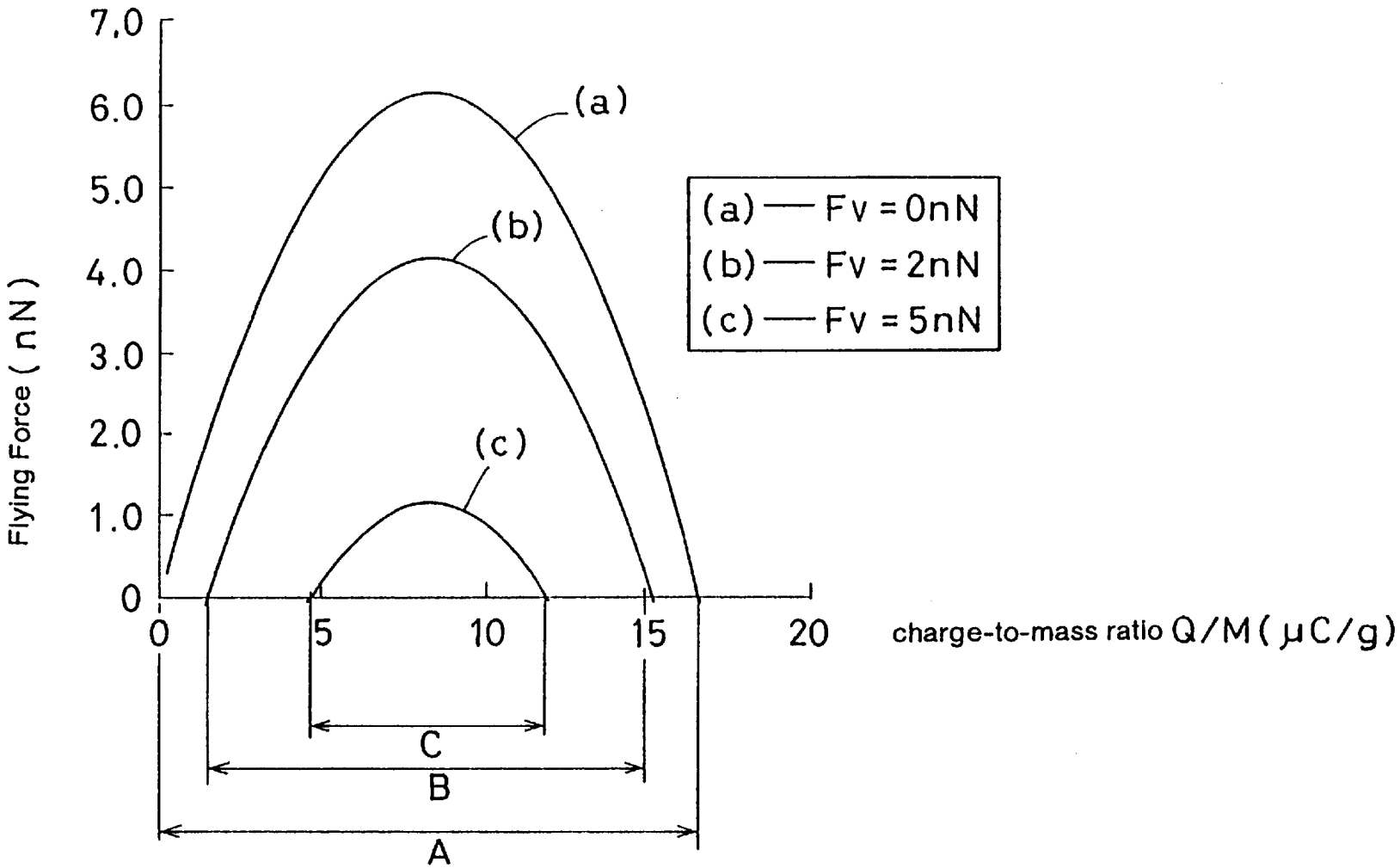
FIG. 10 is a graph showing allowable ranges of the charge-to-mass ratio Q/M of a toner with respect to the value of inter-particle force Fv in accordance wiht the invention.

In FIG. 10, the allowable ranges of the charge-to-mass ratio when the inter-particle force Fv=0, 2 and 5 nN are A, B and C (A>B>C) and it can be seen that the greater the value of the inter-particle force Fv is, the lower the flying quality of the toner for assuring the required amount to be developed and the narrower the allowable range of the charge-to-mass ratio is. It hampers the improvement of the image quality as described before. It can be seen that it is important to reduce the inter-particle force Fv of the toner in order to make it possible to develop even with the small size toner and with a relatively high charge.

Figure 11:
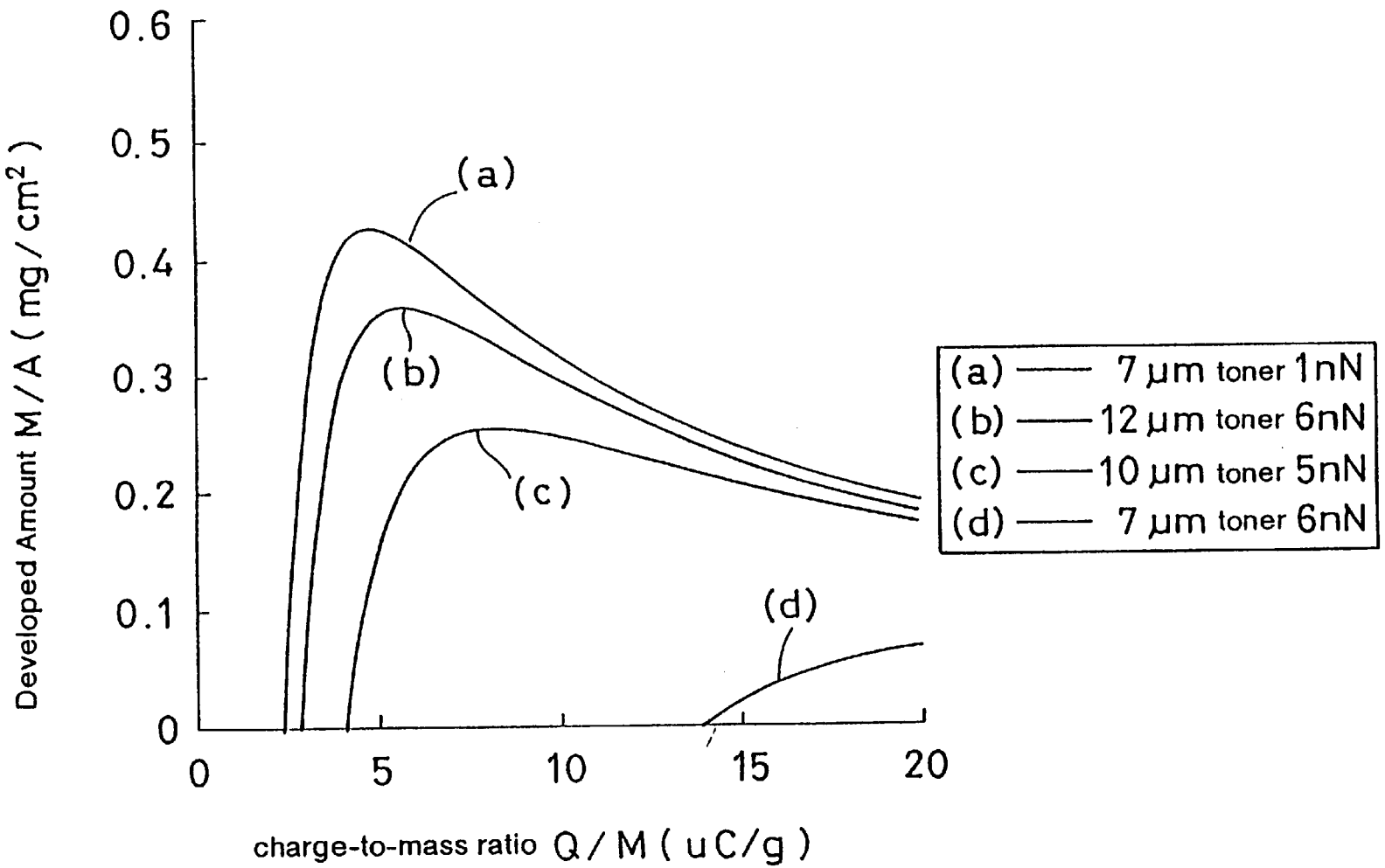
FIG. 11 is a graph showing relationship between the charge-to-mass ratio of a toner and the amount to be developed with respect to a toner particle size/inter-particle force.

FIG. 11 is a graph showing a relationship between the toner charge-to-mass ratio and the amount to be developed with respect to the particle size/inter-particle force of the toner. For example, while toner having 12 $\mu$m of particle size can assure 0.25 mg/cm$^2$ of amount to be developed M/A even when the inter-particle force Fv is 6 nN, the developed amount decreases considerably in case of a toner having 7 $\mu$m of particle size when the Fv is 6 nN as shown in FIG. 11. Meanwhile, the toner with 7 $\mu$m of particle size can have the same or higher flying property as the toner with 12 $\mu$m of particle size under the condition of Fv=1 nN. It can be then understood from FIGS. 10 and 11 that Fv must be kept at 5 nN or less in order to assure more than 0.25 mg/cm$^2$ of toner amount separated by the development among the toners whose particle size is less than 11 $\mu$m and laminated and carried on the toner carrier.

Reducing, by this way, the inter-particle force Fv which is an adhesive force of the toner means that it can be controlled only by the electrostatic force. Because the inter-particle force Fv is susceptible to the influence of the environment such as temperature and humidity from the beginning, the flying property of the toner is swayed, rendering it impossible to obtain a stable flying-development. However, the use of a toner having a small Fv value allows the toner having a relatively high charge-to-mass ratio to be used and allows an electrical control to be implemented readily. Then, the present invention provides a non-magnetic monocomponent toner having a small inter-particle force Fv. When Fv was evaluated by the above-mentioned method by producing, in a trial, various nonmagnetic monocomponent toners having an average particle size of 11 μm or less, it was found that the effect of reducing the value of Fv is significant when particles of 0.01 μm to 1 μm in diameter are added.

The method of adding another kind of particles to the toner for the purpose of improving the characteristics of the toner has been described, for example, in Japanese Examined Patent Publications No. Sho. 59(1984)-7098 and No. Hei. 2(1990)-45191 as described before. In the Publication No. Sho. 59(1984)-7098, a hydrophobic silica is contained in the toner to improve the fluidity of the toner and to prevent coagulation. In the Publication No. Hei. 2(1990)45191, a granulating silica powder having 1 μm to 100 μm of particle size is contained to improve frictional charging performance of the toner.

In the present invention, the charging performance of the toner is controlled by adding a CCA (a toner charge control agent) and particles having 0.01 μm to 1 μm of diameter are contained as a factor for controlling the adhesive force of the toner.

The inter-particle force of the toner can be reduced and the inter-particle force Fv at the flying section of the toner layer on the toner carrier can be reduced to 5 nN or less by including the particles having 0.01 μm to 1 μm of diameter in the toner having an average particle size of 11 μm or less.

As a result, the amount to be developed can be assured in the flying-development even with the small size toner of 11 μm or less. The effect of reducing the adhesive force becomes low when particles whose diameter is less than 0.01 μm are added to the toner whose average particle size is 11 μm or less. Further, when particles larger than 1 μm are added, it gives a bad influence to the image quality because their size is close to that of the toner particle.

As described above, the amount to be developed can be assured in non-contact even with the small size toner whose diameter is 11 μm or less by finding the inter-particle force Fv other than the image-force Fi which acts on the section of the toner layer on the toner carrier and by reducing the value to 5 nN or less.

FIG. 12 is a table showing results of the flying experiment of the inventive toners. As shown in the Figure, the results of the experiment carried out with respect to the toners (toners A through F) each having different average particle size d, average charge-to-mass ratio Q/M and inter-particle force Fv are shown in the table form. Among the items [1] through [21] in the figure, the measured values in the items from [7] to [14] are average values taken by carrying out the same measurement by three times.

The toner A is a toner having an average particle size of 12.3 μm and a small charge-to-mass ratio of 2.1 μC/g. No external additive is added to this toner, so that the inter-particle force Fv is 6.77 nN and is relatively large.

The toner B is a toner having a small average particle size of 7.3 μm and a very large chargeability such that a charge-to-mass ratio thereof is 31.9 μC/g. No external additive is added to this toner. The inter-particle force Fv at this time is 8.28 nN.

The toner C has an average particle size equal to that of the toner B, which is 7.3 μm, and has 14 μC/g of charge-to-mass ratio which is the intermediate value between the toners A and B. Silica particles having 0.02 μm of average particle size are added externally as an external additive. The inter-particle force Fv at this time is 0.79 nN.

The toner D has 7.3 μm of average particle size and 14 μC/g of charge-to-mass ratio and contains conductive particles having 0.5 μm of average particle size added to it as an external additive. The inter-particle force at this time is 0.47 nN.

The toners E and F have the respective values as shown in the table.

When the upper limit of the charge-to-mass ratio is calculated by the equation (14) assuming that the required amount to be developed would be 0.3 mg/cm$^2$ with respect to the toners A through E, it can be seen from the table that the resultant values are 17.3, 14.3, 20.0, 21.8 and 20.6 μC/g, respectively, and that although the toners A, C, D and E stay within the range of the equation (14), the toner charge-to-mass ratio B is out of the adequate range.

In the experiment, while the flying amount $W_1$ of the toner A is 0.36 mg/cm$^2$, that of the toner C is 0.30 mg/cm$^2$, that of the toner D is 0.28 mg/cm$^2$ and that of the toner E is 0.30 mg/cm$^2$, which are close to the required amount to be developed, the flying amount $W_1$ of the toner B is 1/100 of the target value and almost nothing is developed.

The adequacy of the equation (14) could be proved from the above.

Next, the analysis of the rate of the reverse polarity toner will be explained. When the toner charge distribution flied on the drum 3 assumed to be the electrostatic latent image holder was measured by a simple harmonic oscillatory air current method by using a laser Doppler method (E-Spart Analyzer of Hosokawa Micron Co.), while a voluminal rate Rv of the reverse polarity toner of the toner A whose average charge-to-mass ratio Q/M is 2.1 μC/g was 28.5%, Rv of the toner D whose Q/M is 5.1 μC/g was 9.8%, Rv of the toner E whose Q/M is 7.3 μC/g was 5.2% and Rv of the toner F whose Q/M is 8.2 μC/g was 3.0%. The flying amount of the toner B was so small that no measurement could be implemented. From above, the rate of the reverse polarity toner of the toners whose average charge-to-mass ratio exceeds 5 μC/g could be reduced to less than 10%. It was also confirmed that the greater the Q/M is, the smaller the rate of the reverse polarity toner after the development is.

From the results of the toner flying experiment, it was proven that the required amount to be developed $W_1$ (the amount of the toner separated by development among the toners laminated and carried on the toner carrier) can be assured by reducing the inter-particle force Fv of the toner of 11 μm or less to 5 nN or less. The inter-particle force Fv can be obtained by substituting the measured values into the equations (1) through (3).

It was also proved that the inter-particle force Fv can be further reduced by adding the particles of 0.01 μm to 1 μm to the toner of 11 μm or less.

Further, the effectiveness of the lower and upper limits of the charge-to-mass ratio (Q/M) in the inequality (4):

$$5\ \mu C/g \leqq Q/M \leqq (\epsilon_0\ \epsilon_T/W_1)\cdot E,$$

was proved.

While it has been considered in the past that the essence of non-contact development is to carry a toner having a lower charge-to-mass ratio Q/M (3 $\mu$C/g) or a lower charge density Q/A ($3\times10^{-10}\leqq|Q/A\ (C/m^2)\leqq|10^{-7}$) on the toner carrier with, for example, a lower packing density δP (0.1 g/cm$^3$ to 0.6 g/cm$^3$) and with a thicker toner layer $dt_1$ (15 $\mu$m to 100 $\mu$m), it is not practical because it contains much reverse polarity toner as can be seen from the result of the flying experiment of the toner A carried out under the conditions which are close to the above-mentioned developing conditions.

However, as the result of the flying experiment of the toners C through F shows, the toner having a higher charge-to-mass ratio Q/M (5.1 $\mu$C/g to 14.0 $\mu$C/g) can be carried on the toner carrier and flying-developed with a higher packing density δP (0.51 g/cm$^3$ to 0.82 g/cm$^3$) and with a thinner toner layer $dt_1$ (8.5 $\mu$m to 15.5 $\mu$m) and an excellent image quality having a smaller voluminal rate Rv of the reverse polarity toner can be obtained by suppressing the inter-particle force Fv of the toner to 0.79 nN to 2.79 nN by the means for controlling the electrostatic force and the field strength.

Here, packing density (δP)=true density (b)×packing rate (P), and thickness of toner layer ($dt_1$)=toner mass per unit area (M/A)÷packing density (δP).

The toner whose flying amount is the largest among the toners shown in the table in FIG. 12 is the toner F whose average particle size is the largest next to the toner A and 0.5 g/cm$^2$ of developed amount can be obtained per one turn of the toner carrier (the developing roller). When the developed amount is more than 0.5 g/cm$^2$, an optical reflection density of more than 1.3 can be obtained, so that the desirable performance can be assured with the developing unit in which the ratio of peripheral speed k of the developing roller=1 with respect to the toner F. Meanwhile, considering the developing unit using the toner C, the toner C is a toner whose particle size is the smallest, whose charge-to-mass ratio is higher and whose voluminal rate Rv of the reverse polarity toner is 1.4% which is sufficiently small. Accordingly, although the toner C is expected to give an image quality having an excellent sharpness with the synergetic effect of improving the image quality by reducing the particle size, the developed amount per one turn of the developing roller is 0.3 mg/cm$^2$ and is not reaching the required amount of 0.5 mg/cm$^2$ to be developed.

Accordingly, the total amount to be developed on the electrostatic latent image holder must be increased by increasing the ratio of the peripheral speed k of the developing roller to more than one. However, because the edge enhancement is caused as described before under the condition of a large ratio of the peripheral speed, the inequality (5), i.e., $W_D\leqq W_1\cdot k\leqq W_R$, must be further satisfied in order to realize the developing unit which causes no edge enhancement.

Therefore, an arrangement which satisfies the both developing conditions of the inequalities of (4) and (5) becomes important.

In order to confirm the effectiveness of the inequality (5) of the present invention, a developing unit having the same arrangement as the experimental developing unit in FIG. 1 was incorporated into an actual copying process to carry out a copying test using the toner C. A type of copier having a copying rate of 20 sheets/minute and a processing speed of 175 mm/second was used.

When the required amount to be developed $W_D$ is 0.5 mg/cm$^2$, substituting 0.3 mg/cm$^2$ of developed amount $W_1$ per one turn of the developing roller of the toner C and 0.6 mg/cm$^2$ of toner mass per unit area $W_R$ in the inequality (5) gives the following results:

$$0.5\leqq0.3\cdot k\leqq0.6$$

and $$1.67\leqq k\leqq2.00$$

Then, the ratio of the peripheral speed k was set at 1.7.

That is, the drum 3, i.e., the electrostatic latent image holder, was rotated clockwise with 175 mm/second of the peripheral speed and the developing roller 2 was rotated counterclockwise with 300 mm/second of the peripheral speed. The gap between the drum 3 and the developing roller 2 was set at 0.13 mm.

A potential of the latent image at the image portion of the drum 3 was set at −700 V and the developing roller 2 was grounded. Copied images were taken under these developing conditions. They were then photographed by a CCD camera, moved in the Y-axis direction on the recording sheet 50 shown in FIG. 5 and were taken in by setting the output level i of the CCD camera as the data of one pixel with 256 gradations. When these data were translated into density data by using the relationship of reflection density D=−ln (i/256), a density distribution as shown in FIG. 13 could be obtained.

Figure 13:
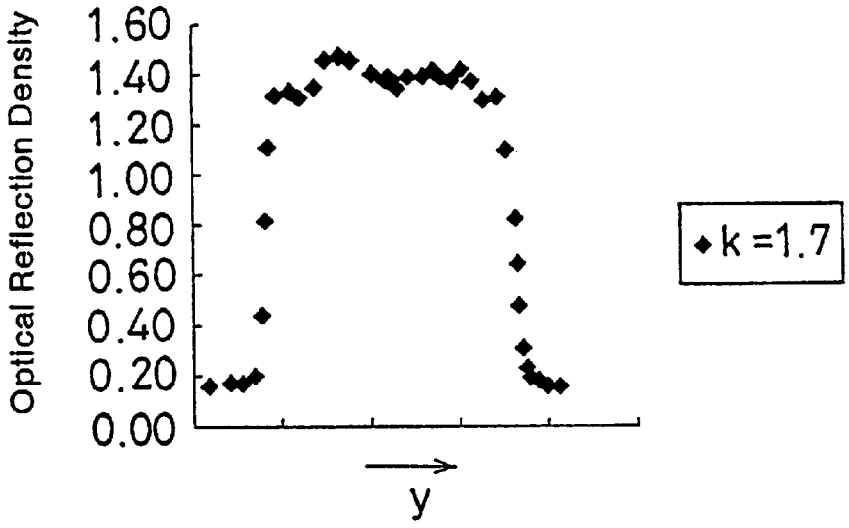
FIG. 13 is a graph showing an actually measured example 1 of the density distribution of a copied image developed by the inventive developing method.

FIG. 13 is a graph showing an actually measured example 1 of the density distribution of the copied image flying-developed by the inventive developing method. As shown in the figure, a good image quality having no edge enhancement and no background fog can be obtained with more than 1.4 of optical reflection density when the ratio of the peripheral speed k (peripheral speed of developing roller/peripheral speed of drum) is set at 1.7.

Further, when a repetitive pattern of black and white stripes was copied and the copied image was evaluated by the CCD camera to determine the resolution, the resolution which enables to reproduce 5 lp/mm was obtained.

Further, in order to verify the effectiveness of the inequality (5), a copying test was carried out by using the same developing unit as that used in the embodiment described above and by changing the ratio of the peripheral speed k of the developing roller for comparison.

Figure 14:
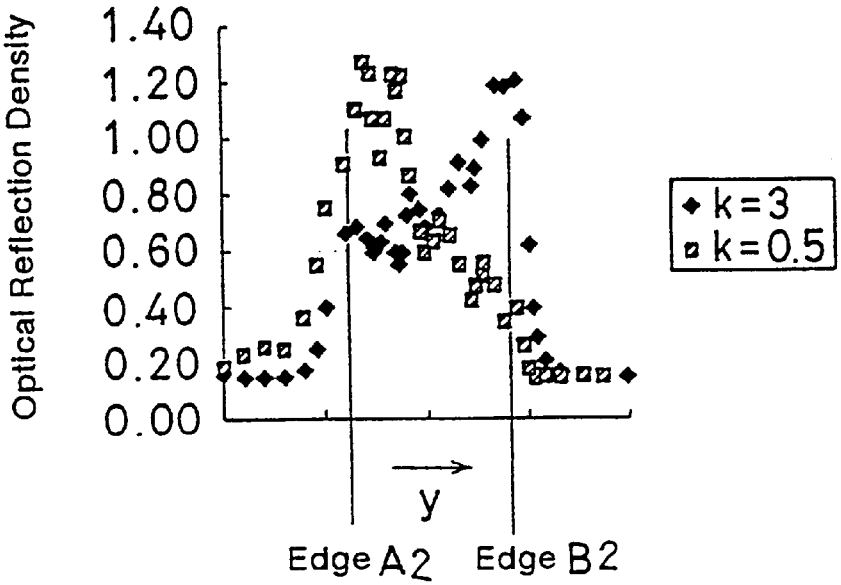
FIG. 14 is a graph showing an actually measured example 2 of the density distribution of a copied image developed by the inventive developing method.

FIG. 14 is a graph showing an actually measured example 2 of the density distribution of the copied image flying-developed by the inventive developing method. It shows results of the density distribution of the toner deposit portion $S_D$ with respect to the Y-axis direction (direction from the edge A2 to the edge B2) when k=3 and k=0.5.

When k=3, density of the edge B2 was emphasized and when k=0.5, the edge A2 was emphasized, disallowing to obtain a homogeneous density distribution.

It is noted that the density distribution when the developing roller and the drum are rotated in the opposite direction from each other as shown in (3-*b*) in FIG. 6 was such that the edge A2 was highly emphasized.

The copying tests described above proved that a developing unit in which the developed amount is increased without having any edge enhancement can be provided by arranging so that the developed amount per one turn of the developing roller, the ratio of the peripheral speed of the developing roller and the required amount to be developed satisfy the inequality (5).

While it has been explained in the present embodiment that the desirable developing unit can be realized by combining an inventive arrangement for setting the developing condition of the inequality (4) with an inventive arrangement for setting the developing condition of the inequality (5) in the case when the toner such as the toner C whose particle size is small, whose charge-to-mass ratio is relatively large and whose developed amount is small is used, it is possible to realize the developing unit which satisfies the developing condition of the inequality (4) or of the inequality (5) without combining those two inventions when the developed amount exceeds the developed amount per one turn of the developing roller.

That is, the developing unit which can satisfy the developing condition of the inequality (4) can be constructed by setting the ratio of the peripheral speed k at 1 or an arrangement which does not satisfy the two developing conditions at the same time (means of setting the ratio of the peripheral speed k to a value smaller than 1), though it is included in the invention satisfying the developing condition of the inequality (5), is also possible.

The inventive non-magnetic monocomponent non-contact development allowed linear Gamma characteristics (tone reproduction) to be obtained without any offset in the development starting potential owing to the features thereof that there is no magnetic restraint at the developing section, that it allows the development only by the control of the electrostatic force and the electric field strength acting on the toner and that the mechanical adhesive force of the toner is small. Due to that, it allowed the development faithful to a latent image potential to be realized and good images containing half-tones like a photograph to be copied.

It is noted that although the toner supplying member 6 which contacts the toner carrier 2 has been used as means to charge and to supply the non-magnetic monocomponent toner 1, i.e., it charges the non-magnetic monocomponent toner by the friction with the toner carrier 2 and applies it onto the toner carrier 2, in the embodiment of the present invention, it is possible to use means of injecting charge from a conductive electrode or of corona discharge as means for charging the non-magnetic monocomponent toner.

Although the change of the toner charging and applying means may change the toner charge-to-mass ratio and the toner mass per unit area on the developing roller even if the same toner is used, the developing unit which allows an excellent image quality having less reverse polarity toner and no background fog to be obtained and to avoid the edge enhancement may be provided by controlling the electrostatic force and the electric field strength acting on the toner.

Further, although the developing roller has been provided as a toner carrier in the present invention, it is also possible to use means other than the roller. For example, the developing unit which has been applied to the embodiment of the present invention may be provided even when a turning developing belt is used as a toner carrier.

As described above, according to the present invention, the stable non-contact development can be realized only by means for controlling the electrostatic force and the electric field strength acting on the toner by suppressing the inter-particle force of the toner other than the image-force which acts on the toner to 5 nN or less. As a result, the present invention brings about the following effects:

a) It provides a stable flying-development having a large allowable width of the toner charge-to-mass ratio to be realized;

b) It can provide the non-contact developing method which provides images having less reverse polarity toner, having no background fog and having an excellent sharpness; and c) It provides a non-contact development even with the small size toner whose particle size is 11 $\mu$m or less, thus providing a non-contact developing method excellent in resolution and gradation. Accordingly, it is not necessary to develop images in such a manner that a monochromatic image is contactingly developed in order to secure the resolution and a color image is non-contactingly developed aiming at gradation and convenience of color superimposition as in a conventional method.

The applicable range of the present invention is broadened further by controlling the ratio of the peripheral speeds of the toner carrier and the electrostatic latent image holder. That is, d) It can provide a sufficient development density even with a toner having a low developed amount per one turn of the developing roller;

e) At that time, it prevents the edge enhancement which might be caused by setting the ratio of the peripheral speed and thus allows a homogeneous density distribution to be obtained; and f) As a result, toners with a high charge-to-mass ratio which could not be put into practical use in the past because of its low developability can be actively used. That is, the toner having a high charge-to-mass ratio can be held on the developing roller even when the roller rotates at a high-speed and is thus applicable to a high-speed process.

As described above, the present invention can provide a developing unit which can be applied to the non-contact development without setting any particular restriction on the charge-to-mass ratio and the particle size of the toner, which can realize development in a low-speed through high-speed process, whether in monochrome or color, and which can be widely utilized as an image forming unit of copiers and printers.

While the preferred embodiments have been explained, it is to be understood that various modifications thereto will occur to those skilled in the art within the specific scope of the present inventive concepts which are exhibited by the following claims.

What is claimed is:

1. A non-contact developing method in a developing unit comprising at least a toner carrier for laminating and carrying a charged toner with a predetermined thickness as a developer, the toner being given a predetermined packing density and a predetermined charge-to-mass ratio by a blade, an electrostatic latent image holder disposed so as to face to the toner carrier with a predetermined gap and electric field applying and controlling means for applying and controlling an electric field between the toner carrier and the electrostatic latent image holder, the method comprising flying-developing the toner to the electrostatic latent image holder, the toner being controlled so that the toner laminated and carried on the toner carrier has an inter-particle force satisfying the following formula (1):

$$0.01\ \text{nN} \leqq Fv = q \cdot E - Fi \leqq 5\ \text{nN} \tag{1}$$

where Fv is the inter-particle force, q·E is a Coulomb force, Fi is an image-force on a surface of the toner carrier, q is a quantity of charge (C) of the toner, E is an electric field strength (V/m) acting on the toner.

2. A non-contact developing method according to claim 1, in which the Coulomb force q·E and the image-force Fi of the toner laminated and carried on the toner carrier satisfy the following formulas (2) and (3), respectively:

$$q \cdot E = q \cdot \{Vb + (Q/M) \cdot \delta \cdot P \cdot dt_1^2 / (2\epsilon_0 \epsilon_T)\} / (\epsilon_T \cdot g + dt_1) \tag{2}$$

$$Fi = \{(W_1 \cdot \pi d^3 \cdot \delta) / (6\epsilon_0 \epsilon_T)\} \cdot (Q/M)^2 \tag{3}$$

where q is the quantity of charge (C) of the toner, E is the electric field strength (V/m) acting on the toner, Q/M is the charge-to-mass ratio ($\mu$C/g) of the toner, $W_1$ is an amount of toner (mg/cm$^2$) to be separated by development among the toner laminated and carried on the toner carrier, $\epsilon_0$ is a vacuum dielectric constant (C/(V·m)), $\epsilon_T$ is an apparent specific dielectric constant (C/(V·m)) of the toner, d is an average particle size ($\mu$m) of the toner, $\delta$ is a true density (g/cm$^3$) of the toner, g is a gap (mm) between an outermost surface of the toner on the toner carrier and the electrostatic latent image holder, $dt_1$ is the thickness ($\mu$m) of a toner layer on the toner carrier, Vb is a development bias voltage (V) and P is the packing density of the toner.

3. A non-contact developing method according to claim 1, in which the average particle size of the toner laminated and carried on the toner carrier is 5 $\mu$m to 11 $\mu$m.

4. A non-contact developing method according to claim 1, in which the toner laminated and carried on the toner carrier further comprises inactive micro particles whose average particle size is 0.01 $\mu$m to 1 $\mu$m as a spacer.

5. A non-contact developing method according to claim 1, in which the charge-to-mass ratio of the toner laminated and carried on the toner carrier is within the range of 5 $\mu$C/g to 15 $\mu$C/g.

6. A non-contact developing method according to claim 1, in which the average particle size of the toner laminated and carried on the toner carrier is within the range of 5 $\mu$m to 11 $\mu$m and the charge-to-mass ratio of the toner is within the range of 5 $\mu$C/g to 15 $\mu$C/g.

7. A non-contact developing method according to claim 1, in which the thickness of the toner laminated and carried on the toner carrier is within the range of about 5 $\mu$m to 20 $\mu$m, and the packing density of the toner is within the range of about 0.4 g/cm$^3$ to 0.85 g/cm$^3$.

8. A non-contact developing method according to claim 1, in which the thickness of the toner laminated and carried on the toner carrier is which the range of about 5 $\mu$m to 20 $\mu$m, the charge-to-mass ratio of the toner is within the range of 5 $\mu$C/g to 15 $\mu$C/g, and the packing density of the toner is within the range of about 0.4 g/cm$^3$ to 0.85 g/cm$^3$.

9. A non-contact developing method according to claim 1, in which the toner laminated and carried on the toner carrier is an image forming toner mainly composed of a binder resin and containing optionally a colorant, an internal additive and an external additive.

10. A non-contact developing method according to claim 1, in which the laminated and carried on the toner carrier is a nonmagnetic monocomponent toner.

11. A non-contact developing method according to claim 1, in which the toner laminated and carried on the toner carrier is formed to have a predetermined average particle size by melting, kneading and crushing processes.

12. A non-contact developing method according to claim 1, in which the electric field applying and controlling means controls the charge-to-mass ratio of the toner laminated and carried on the toner carrier so that the charge-to-mass ratio satisfies the following formula (4):

$$5\ \mu C/g \leqq Q/M \leqq (\epsilon_O \epsilon_T / W_1) \cdot E \quad (4)$$

where E is the electric field strength (V/m) acting on the toner, Q/M is the charge-to-mass ratio ($\mu$C/g) of the toner, $W_1$ is an amount of toner (mg/cm$^2$) to be separated by development among the toner laminated and carried on the toner carrier, $\epsilon_O$ is a vacuum dielectric constant (C/(V·m)), and $\epsilon_T$ is an apparent specific dielectric constant (C/V·m)) of the toner.

13. A non-contact development method according to claim 1, in which the developing unit further comprises peripheral speed ratio control means which controls a ratio of peripheral speeds of the toner carrier and the electrostatic latent image holder so that the ratio satisfies the following formula (5):

$$W_D \leqq W_1 \cdot k \leqq W_R \quad (5)$$

where the toner carrier and the electrostatic latent image holder move in the same direction, k is the ratio of peripheral speeds of the toner carrier and the electrostatic latent image holder, $W_R$ is a mass per unit area (mg/cm$^2$) of the toner on the toner carrier for carrying the toner, $W_1$ is an amount of toner (mg/cm$^2$) to be separated by development among the toner laminated and carried on the toner carrier $W_D$ is a required amount to be developed (mg/cm$^2$).

14. A non-contact developing method in a developing unit comprising at least a toner carrier for laminating and carrying a charged toner with a predetermined thickness as a developer, the toner being given a predetermined packing density and a predetermined charge-to-mass ratio by a blade, an electrostatic latent image holder disposed so as to face to the toner carrier with a predetermined gap and electric field applying and controlling means for applying and controlling an electric field between the toner carrier and the electrostatic latent image holder, the method comprising flying-developing the toner to the electrostatic latent image holder, and controlling the toner so that the toner laminated and carried on the toner carrier has an inter-particle force satisfying the following formula (1):

$$0.01\ nN \leqq Fv = q \cdot E - Fi \leqq 5\ nN \quad (1)$$

where Fv is the inter-particle force, q·E is a Coulomb force, Fi is an image-force on a surface of the toner carrier, q is a quantity of charge (C) of the toner, and E is an electric field strength (V/m) acting on the toner.

15. A non-contact developing method according to claim 14, further including the step of:

controlling the charge-to-mass ratio of the toner laminated and carried on the toner carrier by the electric field employing and controlling means so that the charge-to-mass ratio satisfies the following formula:

$$5\ (\mu C/g) \leqq Q/M \leqq (\epsilon_0\ \epsilon_T / W_1) \cdot E \quad (4)$$

where E is the electric field strength (V/m) acting on the toner, Q/M is the charge-to-mass ratio ($\mu$C/g) of the toner $W_1$ is an amount of toner (mg/cm$^2$) to be separated by development among the toner laminated and carried on the toner carrier, $\epsilon_0$ is a vacuum dielectric constant (C/(V·m)), and $\epsilon_T$ is an apparent specific dielectric constant (C/(V·m)) of the toner.

16. A non-contact development method according to claim 14, further including the step of:

controlling a ratio of peripheral speeds of the toner carrier and the electrostatic latent image holder with a peripheral speed ration control means, so that the ratio satisfies the following formula (5):

$$W_D \leqq W_1 \cdot k \leqq W_R \quad (5)$$

where the toner carrier and the electrostatic latent image holder move in the same direction, k is the ratio of peripheral speeds of the toner carrier and the electrostatic latent image holder, $W_R$ is a mass per unit area (mg/cm$^2$) of the toner on the toner carrier for carrying the toner, $W_1$ is an amount of toner (mg/cm$^2$) to be separated by development among the toner laminated and carried on the toner carrier and $W_D$ is a required amount to be developed (mg/cm$^2$).

* * * * *